US011761140B2

(12) United States Patent
Yi et al.

(10) Patent No.: US 11,761,140 B2
(45) Date of Patent: Sep. 19, 2023

(54) WASHING MACHINE

(71) Applicant: SAMSUNG ELECTRONICS CO., LTD., Suwon-si (KR)

(72) Inventors: Seongwoo Yi, Suwon-si (KR); Jun-Young Choi, Suwon-si (KR); Minhyung Kim, Suwon-si (KR); Joonho Kim, Suwon-si (KR); Dong-Il Back, Suwon-si (KR); Byoungwoong An, Suwon-si (KR); Seung-Hun Lee, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 493 days.

(21) Appl. No.: 16/852,909

(22) Filed: Apr. 20, 2020

(65) Prior Publication Data

US 2020/0332456 A1 Oct. 22, 2020

(30) Foreign Application Priority Data

Apr. 19, 2019 (KR) ..... 10-2019-0046321
Aug. 28, 2019 (KR) ..... 10-2019-0105683
Jan. 2, 2020 (KR) ..... 10-2020-0000542

(51) Int. Cl.
*D06F 39/14* (2006.01)
*D06F 33/30* (2020.01)
(Continued)

(52) U.S. Cl.
CPC ..... *D06F 39/14* (2013.01); *D06F 33/30* (2020.02); *D06F 37/42* (2013.01); *D06F 34/20* (2020.02);
(Continued)

(58) Field of Classification Search
CPC ..... D06F 37/42; D06F 39/14; D06F 2103/40; D06F 2105/44; D06F 33/30; D06F 34/20
See application file for complete search history.

(56) References Cited

U.S. PATENT DOCUMENTS 5,323,628 A * 6/1994 Mori ..... D06F 37/42 68/12.26
5,879,036 A * 3/1999 Moline ..... D06F 37/42 292/210
(Continued)

FOREIGN PATENT DOCUMENTS

| | | |
|---|---|---|
| CN | 106978696 | 7/2017 |
| EP | 3299508 | 3/2018 |
| WO | 2013/150410 | 10/2013 |

OTHER PUBLICATIONS

European Search Report for European Application No. 20 169 617.6 dated Jul. 2, 2021.
(Continued)

*Primary Examiner* — Joseph L. Perrin
(74) *Attorney, Agent, or Firm* — STAAS & HALSEY LLP

(57) ABSTRACT

Provided is a washing machine including a main body having a first inlet, a drum arranged inside the main body to accommodate laundry, and a door configured to open and close the first inlet, wherein the door includes a second inlet to allow laundry to be introduced into the drum while the first inlet closed, an auxiliary door configured to open and close the second inlet, and a restraining device configured to restrain the auxiliary door such that the auxiliary door remains locked onto the door, and the main body includes a pressing device arranged inside the main body and configured to press the restraining device such that the restraining
(Continued)

device locks the auxiliary door and to release from the retraining device such that the restraining device unlocks the auxiliary door.

19 Claims, 31 Drawing Sheets

(51) Int. Cl.
*D06F 37/42* (2006.01)
*D06F 105/44* (2020.01)
*D06F 103/40* (2020.01)
*D06F 34/20* (2020.01)

(52) U.S. Cl.
CPC ..... *D06F 2103/40* (2020.02); *D06F 2105/44* (2020.02)

(56) References Cited

U.S. PATENT DOCUMENTS

| | | | | |
|---|---|---|---|---|
| 9,228,382 | B2 * | 1/2016 | Rocchitelli | D06F 37/42 |
| 2015/0292135 | A1 * | 10/2015 | Wish | D06F 39/14 68/139 |
| 2019/0024287 | A1 * | 1/2019 | Kim | E05B 47/0001 |

OTHER PUBLICATIONS

Extended European Search Report dated Sep. 16, 2020 in European Patent Application No. 20169617.6.

* cited by examiner

WASHING MACHINE

CROSS-REFERENCE TO RELATED APPLICATION

This application is based on and claims priority under 35 U.S.C. § 119 to Korean Patent Applications No. 10-2019-0046321, filed on Apr. 19, 2019, No. 10-2019-0105683, filed on Aug. 28, 2019 and No. 10-2020-0000542, Jan. 2, 2020, in the Korean Intellectual Property Office, the disclosures of which are incorporated herein by reference in their entirety.

BACKGROUND

1. Field

The disclosure relates to a washing machine that additionally insert laundry through an auxiliary inlet formed in a door without opening the door, and more specifically, to a locking device of an auxiliary door for opening and closing an auxiliary inlet.

2. Description of the Related Art

A washing machine is an appliance that washes clothes using electric power. In general, a washing machine is divided into a drum washing machine that includes a drum arranged horizontally so that the laundry is lifted upward along the inner circumferential surface of the drum when the drum rotates in a forward and reverse direction about a horizontal axis and a vertical axis washing machine that includes a drum arranged vertically and provided with a pulsator therein so that the laundry is washed using water current generated by the pulsator when the drum rotates in a forward and reverse direction about a vertical axis.

In general, the washing machine includes a main body, a tub for storing washing water in the main body, and a drum rotatably installed in the tub and receiving laundry therein. The main body is provided with an opening through which laundry is introduced into the drum, and the opening is opened and closed by a door.

Since the tub of the drum washing machine is filled with a certain level of washing water during a washing stroke, in order to introduce additional laundry during the washing stroke, the washing water stored in the tub is drained and then the door is opened. Accordingly, there has been suggested a washing machine that has an auxiliary inlet at a door such that laundry is additionally introduced through the auxiliary inlet without opening the door even in a washing stroke where washing water is filled.

SUMMARY

In accordance with one aspect of the disclosure, a washing machine includes: a main body having a first inlet; a drum arranged inside the main body to accommodate laundry; and a door configured to open and close the first inlet, wherein the door includes a second inlet provided to introduce laundry into the drum with the first inlet closed, an auxiliary door configured to open and close the second inlet, and a restraining device configured to restrain the auxiliary door such that the auxiliary door is closed onto the door, and the main body includes a pressing device arranged inside the main body and configured to press the restraining device such that the restraining device locks or unlocks the auxiliary door.

The washing machine may further include a controller arranged inside the main body and configured to transmit an electrical signal to the pressing device, wherein the pressing device may be provided to be electrically connected to the controller inside the main body.

The restraining device may be not electrically connected to the controller.

The auxiliary door may include an insertion portion that is inserted into the restraining device by rotationally moving in a first direction, wherein the restraining device may include: a first restraining part allowing the insertion portion to be inserted thereinto and restraining the insertion portion; and a second restraining part configured to restrain the first restraining part in association with the pressing device.

The first restraining part may be configured to restrain the auxiliary door to maintain the auxiliary door in a closed state in response to the insertion portion being inserted into the first restraining part, and release the restraining of the auxiliary door to open auxiliary the door in response to the auxiliary door being pressed in the first direction.

The pressing device may be configured to press the second restraining part, and the second restraining part may be configured to restrain the first restraining part in association with pressing of the pressing device such that the auxiliary door is locked in a state of being restrained by the first restraining part.

The second restraining part may be configured to release the restraining of the first restraining part in response to the pressing of the pressing device terminated.

The first restraining part and the second restraining part may be arranged in a vertical direction, and the second restraining part may be protruded in a direction toward the first restraining part by being pressed by the pressing device to restrain the first restraining part.

The first restraining part may be configured to be moved in the first direction in association with the insertion portion, and moved in a second direction opposite to the first direction in response to the auxiliary door being pressed in the first direction, and the first restraining part may alternate moving in the first direction to a first position in which the insertion portion is restrained by the first restraining part and moving in the second direction to a second position in which the restraining of the insertion portion is released by the first restraining part.

The second restraining part may be moved in the second direction by being pressed by the pressing device and may be moved in the first direction in response to the pressing of the pressing device being released, and the second restraining part may alternate moving in the second direction to a third position in which the first restraining part is restrained by the second restraining part and moving in the first direction to a fourth position in which the restraining of the first restraining part by the second restraining part is released.

The restraining device may be configured to lock the auxiliary door in response to at least a portion of the auxiliary door being inserted into the restraining device, and the pressing device may be configured to release the locking of the auxiliary door by pressing the restraining device.

The restraining device may include: a locking portion arranged on the auxiliary door and allowing the auxiliary door to be locked onto the restraining device; and a locking member arranged on the door and configured to lock the locking portion, wherein the locking member may be rotated in association with pressing of the locking portion generated in an operation of closing the auxiliary door, and thus may be inserted into the locking portion such that the auxiliary door is locked onto the restraining device, and the locking member may be rotated in association with pressing of the pressing device, and thus may be separated from the locking portion such that the auxiliary door is unlocked from the restraining device.

The main body may further include a door sensor arranged inside the main body and electrically connected to the controller to detect a closed state of the auxiliary door, and the controller may control the pressing device to press the second restraining part in response to the door sensor detecting the closed state of the auxiliary door.

The controller may be configured to control a stroke of the washing machine, and may control the washing machine to perform the stroke only in a state of the second restraining part being pressed by the pressing device.

The washing machine may be further configured to control a stroke, wherein the pressing device may further include a push rod configured to be protruded in a direction of an outer side of the main body to press the second restraining part and a detecting sensor configured to detect a distance moved by the push rod in the second direction, and the controller may prevent the stroke of the washing machine from being performed in response to a value detected by the detecting sensor as being smaller than a predetermined value.

In accordance with another aspect of the disclosure, a washing machine includes: a main body having a first inlet; a drum arranged inside the main body to accommodate laundry; and a door configured to open and close the first inlet, wherein the door includes a second inlet through which laundry is introduced into the drum with the first inlet closed, an auxiliary door configured to open and close the second inlet, and a restraining device configured to restrain the auxiliary door such that the auxiliary door is closed onto the door, wherein the main body includes a locking guide arranged inside the main body and allowing the auxiliary door to be locked onto the restraining device in association with the restraining device.

The restraining device may include: a first restraining part configured to restrain the auxiliary door to hold the auxiliary door closed, and release the restraining of the auxiliary door to open the door in response to the auxiliary door pressed by an external force; and a second restraining part configured to restrain the first restraining part such that the auxiliary door is locked in a state of being restrained by the first restraining part.

The locking guide may be configured to press the second locking portion, and the second locking portion may be configured to restrain the first restraining part in association with the pressing of the locking guide.

The door may omit an electrically connected component.

In accordance with another aspect of the disclosure, a washing machine includes: a main body having a first inlet; a drum arranged inside the main body to accommodate laundry; and a door configured to open and close the first inlet, wherein the door includes a second inlet through which laundry is introduced into the drum with the first inlet closed, an auxiliary door configured to open and close the second inlet, and a locking device including a locking member for locking the auxiliary door, and the auxiliary door includes a locking portion that allows the auxiliary door to be locked onto the door by being coupled to the locking member, and the main body includes an unlock device arranged inside the main body and configured to press the locking member to thereby separate the locking member from the locking portion and unlock the auxiliary door.

Additional aspects of the disclosure will be set forth in part in the description which follows and, in part, will be obvious from the description, or may be learned by practice of the disclosure.

BRIEF DESCRIPTION OF THE DRAWINGS

These and/or other aspects, features, and advantages of certain embodiments of the present disclosure will be more apparent and more readily appreciated from the following description of the embodiments, taken in conjunction with the accompanying drawings of which.

DETAILED DESCRIPTION

Figure 1:
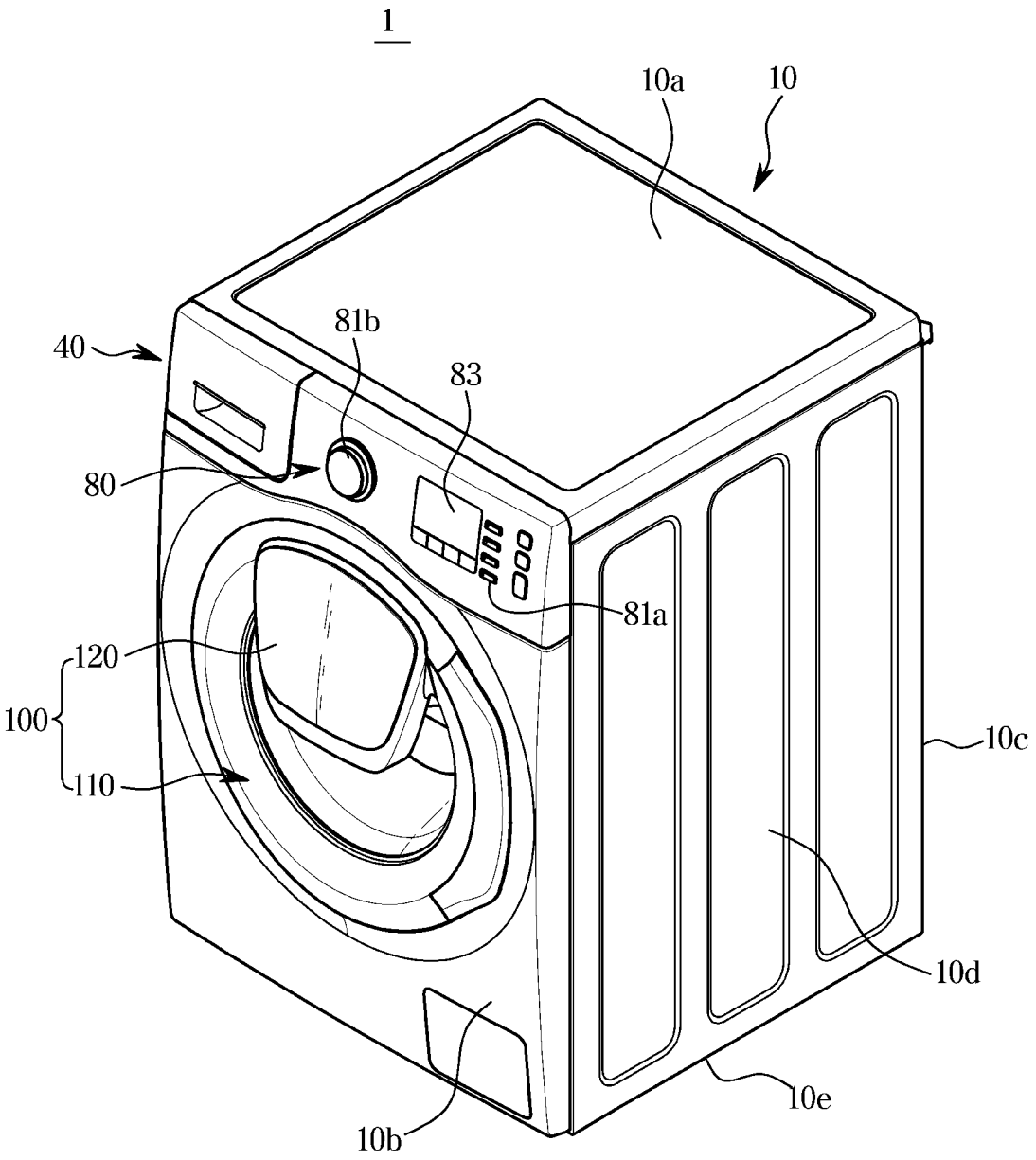
FIG. 1 is a perspective view illustrating a washing machine according to an embodiment of the disclosure.

The embodiments set forth herein and illustrated in the configuration of the present disclosure are only the most preferred embodiments and are not representative of the full the technical spirit of the present disclosure, so it should be understood that they may be replaced with various equivalents and modifications at the time of the disclosure.

Throughout the drawings, like reference numerals refer to like parts or components.

The terminology used herein is for the purpose of describing particular embodiments only and is not intended to limit the disclosure. It is to be understood that the singular forms "a," "an," and "the" include plural references unless the context clearly dictates otherwise. It will be further understood that the terms "include", "comprise" and/or "have" when used in this specification, specify the presence of stated features, integers, steps, operations, elements, and/or components, but do not preclude the presence or addition of one or more other features, integers, steps, operations, elements, components, and/or groups thereof.

The terms including ordinal numbers like "first" and "second" may be used to explain various components, but the components are not limited by the terms. The terms are only for the purpose of distinguishing a component from another. Thus, a first element, component, region, layer or section discussed below could be termed a second element, component, region, layer or section without departing from the teachings of the disclosure. Descriptions shall be understood as to include any and all combinations of one or more of the associated listed items when the items are described by using the conjunctive term "~and/or~," or the like.

Therefore, it is an object of the disclosure to provide a washing machine provided with a locking device for an auxiliary door that opens and closes an auxiliary inlet for additionally introducing laundry during a washing stroke.

It is another object of the disclosure to provide a washing machine having a washing machine door of a simple configuration that omits an electrical device for opening and closing an auxiliary door in the washing machine door.

It is another object of the disclosure to provide a washing machine that adopts a control method for opening and closing an auxiliary door without having an electrical device for opening and closing the auxiliary door in a washing machine door.

Hereinafter, embodiments according to the disclosure will be described in detail with reference to the accompanying drawings.

Figure 2:
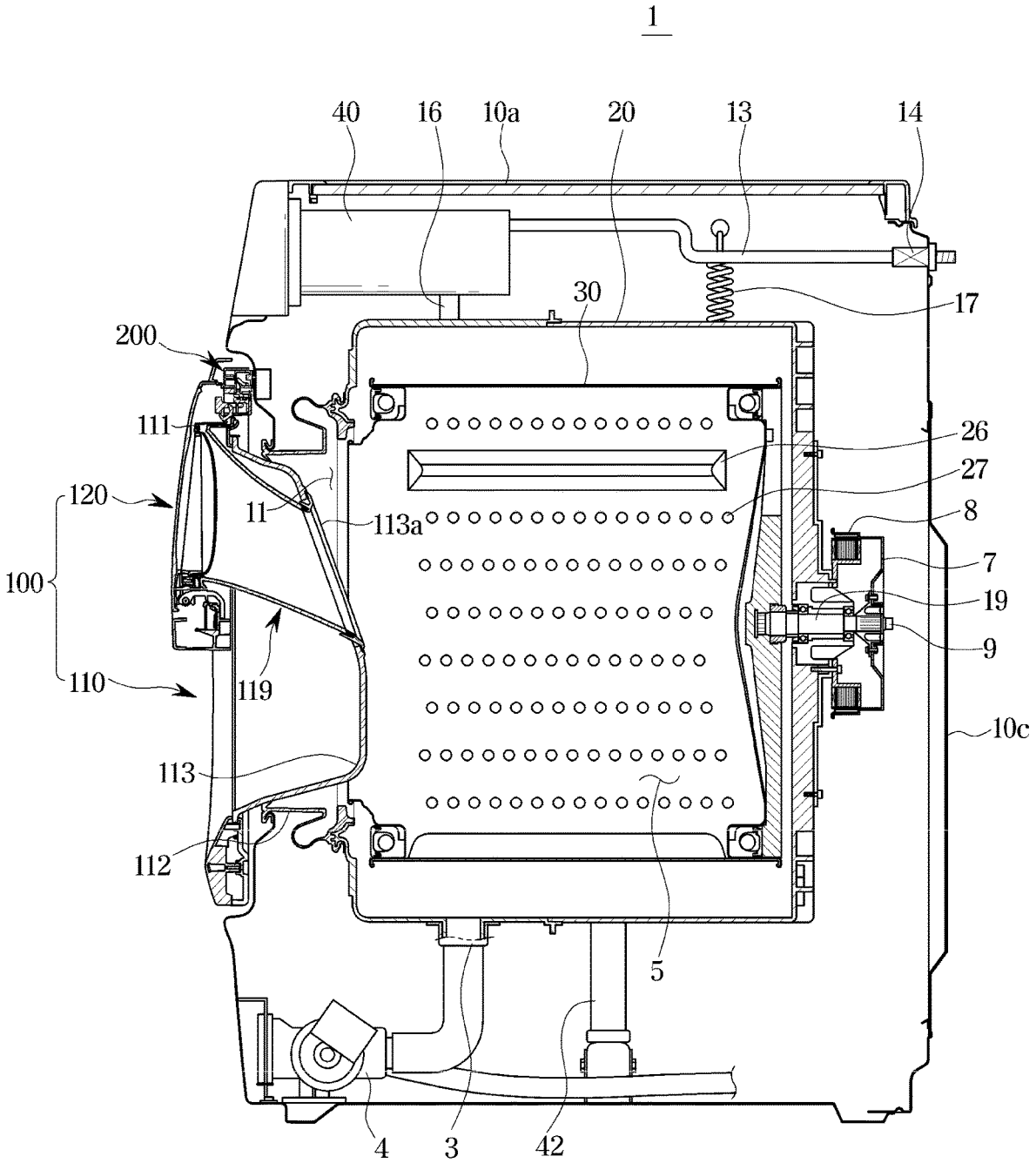
FIG. 2 is a cross-sectional view of a washing machine according to an embodiment of the disclosure.
Figure 3:
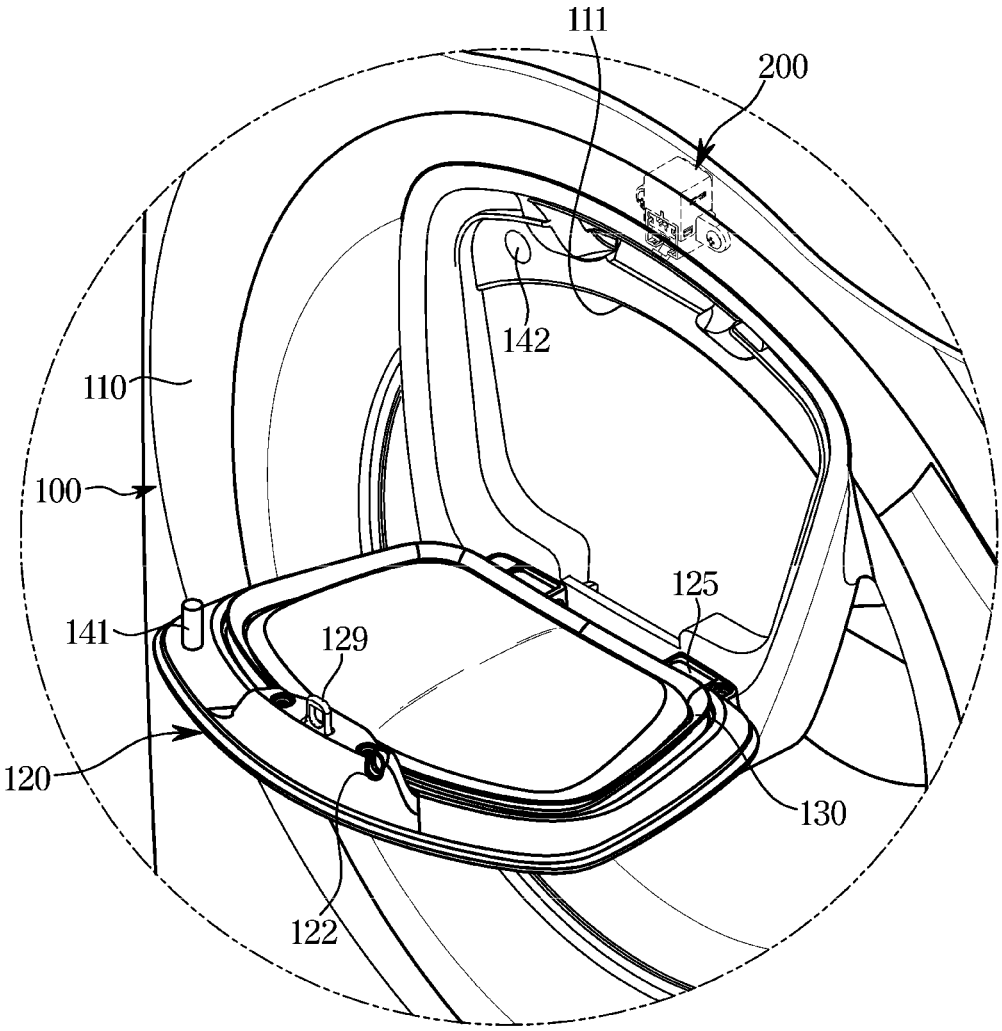
FIG. 3 is an enlarged view of a state of an auxiliary door of a washing machine that is open according to an embodiment of the disclosure.
Figure 4:
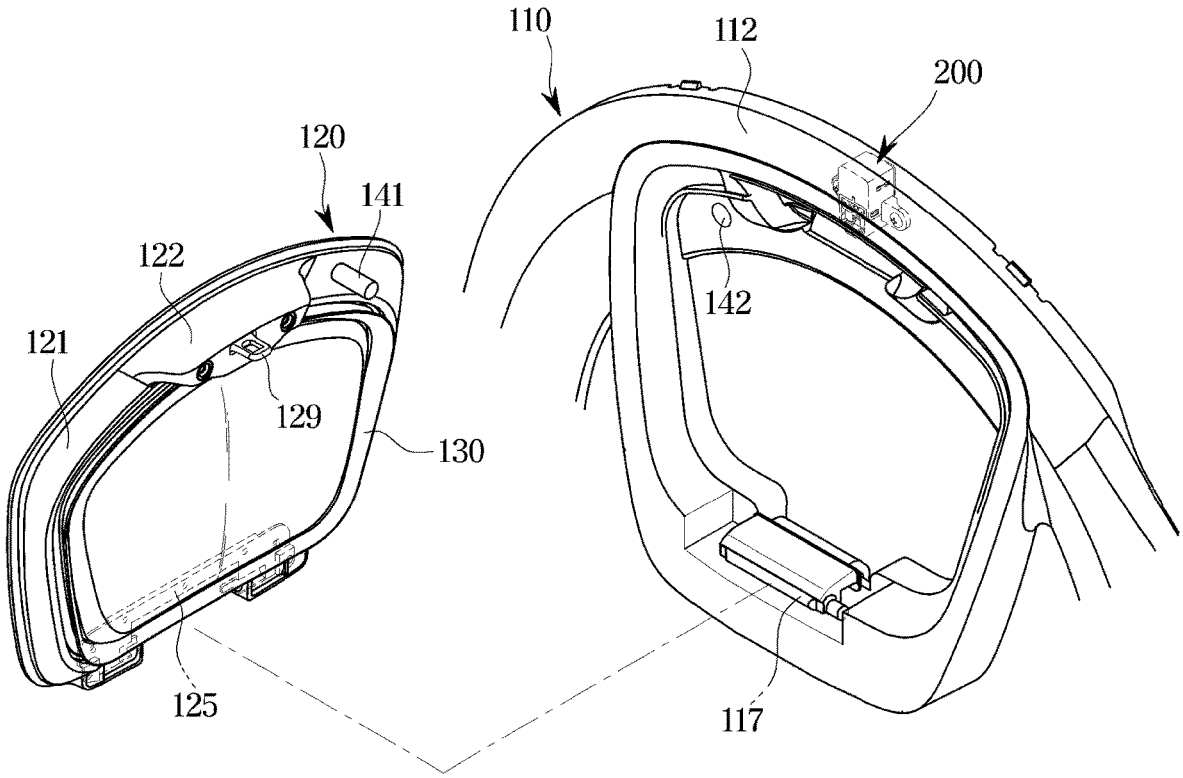
FIG. 4 is an exploded perspective view of a state in which an auxiliary door of a washing machine is dissembled from a door according to an embodiment of the disclosure.
Figure 5:
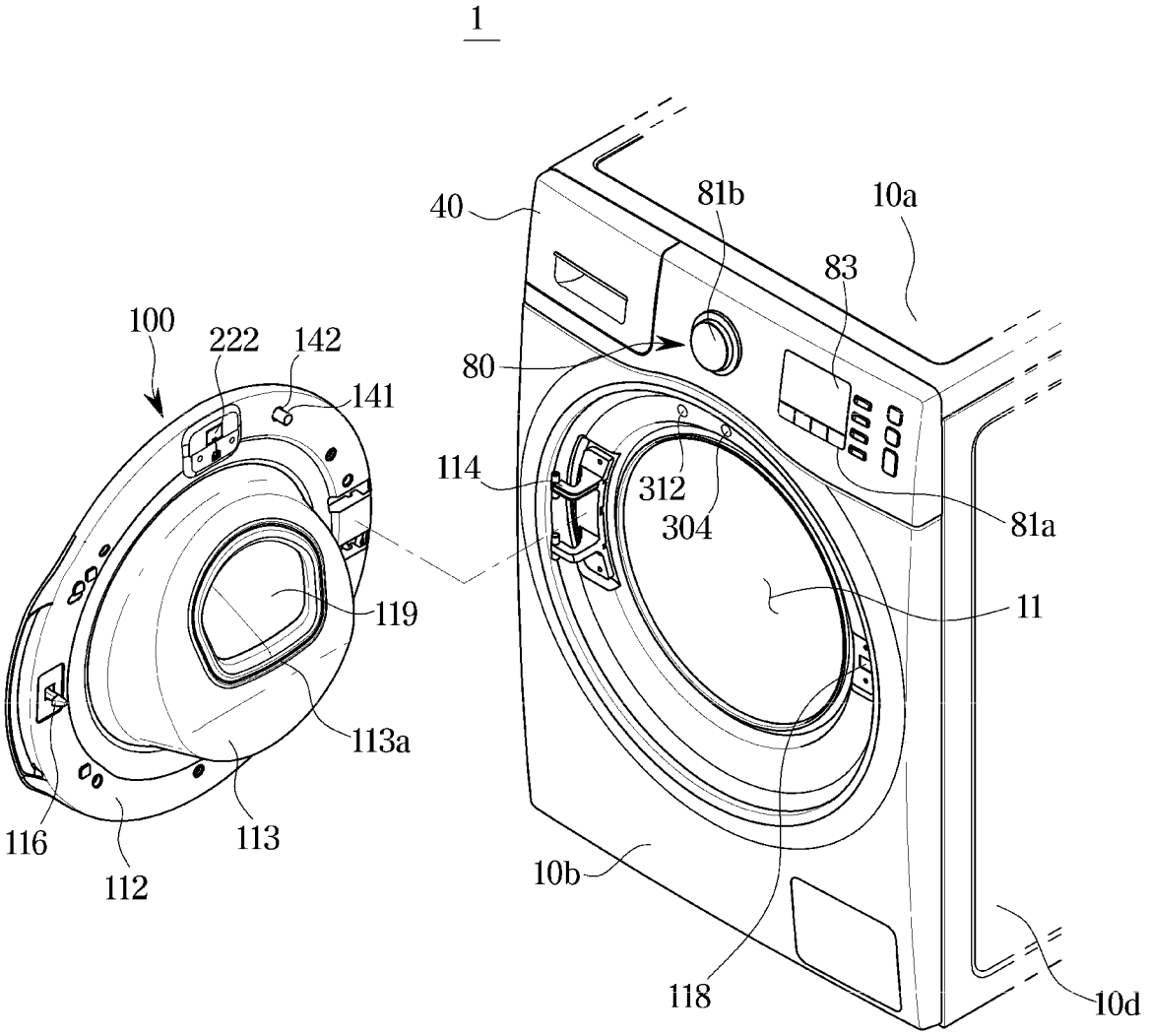
FIG. 5 is an exploded perspective view of a state in which a door of a washing machine is dissembled from a main body according to an embodiment of the disclosure.
Figure 6:
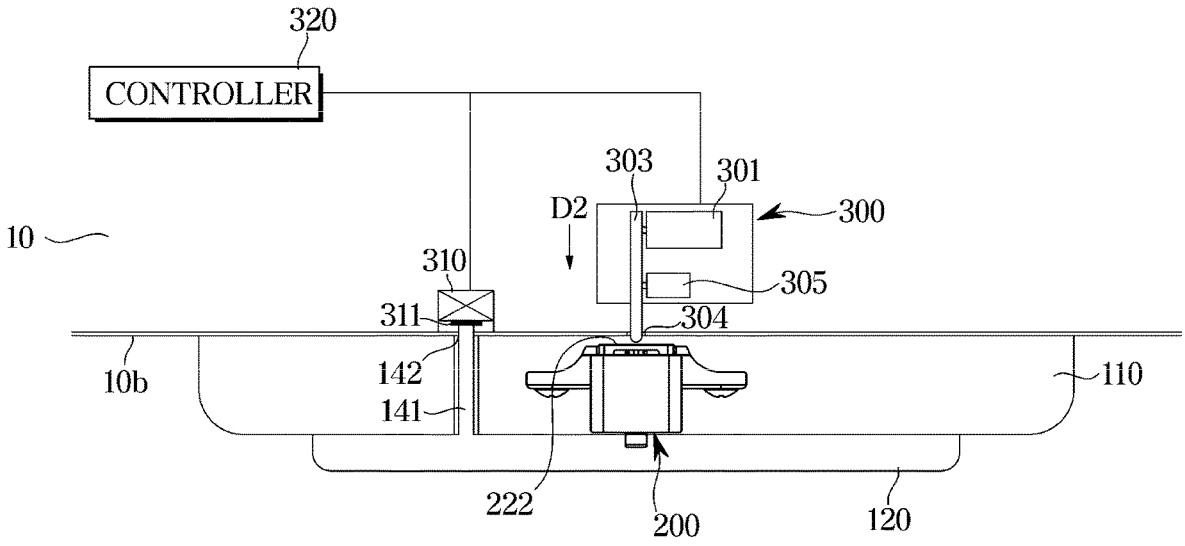
FIG. 6 is a view schematically showing the configuration of a door and a controller according to an embodiment of the disclosure.

FIG. 1 is a perspective view illustrating a washing machine according to the first embodiment of the disclosure, FIG. 2 is a cross-sectional view of a washing machine according to the first embodiment of the disclosure, FIG. 3 is an enlarged view of a state of an auxiliary door of a washing machine that is open according to the first embodiment of the disclosure, FIG. 4 is an exploded perspective view of a state in which an auxiliary door of a washing machine is dissembled from a door according to the first embodiment of the disclosure, FIG. 5 is an exploded perspective view of a state in which a door of a washing machine is dissembled from a main body according to the first embodiment of the disclosure, and FIG. 6 is a view schematically showing the configuration of a door and a controller according to the first embodiment of the disclosure.

Referring to FIGS. 1 and 2, a washing machine 1 includes a main body 10 (or may be referred to as a cabinet) forming a washing space 5 therein, a tub 20 for storing washing water or rinsing water to be used in a washing stroke or a rinsing stroke, and a drive motor 7 for rotating a drum 30. The washing space 5 inside the main body 10 may be formed by the tub 20 and the drum 30.

The main body 10 includes a top panel 10*a*, a front panel 10*b*, a rear panel 10*c*, side panels 10*d*, a bottom panel 10*e* that respectively form the top surface, the front surface, the rear surface, the side surfaces and bottom surface of the main body 10.

A control panel 80 including inputter 81*a* and 81*b* for receiving an operation command of the washing machine 1 from a user and a display 83 for displaying operation information of the washing machine 1 is provided on a front upper portion of the front panel 10*b*.

Below the control panel 80, the front panel 10*b* is provided at the center thereof with an inlet (11, in FIG. 5) through which laundry is introduced into the drum 30, and a door 100 for opening and closing the inlet 11 is hinged to the front panel 10*b*.

A spring 17 may be provided between the tub 20 and the main body 10 to support the tub 20 from an upper side thereof. The spring 17 serves to lessen vibrations and noise generated by movement of the tub 20 by elasticity.

The tub 20 is provided at an upper portion thereof with a water supply pipe 13 to supply washing water to the tub 20. A water supply valve 14 is installed at one side of the water supply pipe 13.

A detergent supply device 40 is connected to the tub 20 through a connecting pipe 16. Water supplied through the water supply pipe 13 is supplied into the tub 20 together with detergent via the detergent supply device 40.

The tub 20 is supported by a damper 42. The damper 42 connects the inner bottom surface of the main body 10 to the outer surface of the tub 20. In addition to being installed on the inner bottom surface of the main body 10, the damper 42 may be positioned on the upper side and the left and right sides of the main body 10 to support the tub 20. The damper 42 or the spring 17, positioned above and below the tub 20, may mitigate vibrations and shocks generated from the up and down movement of the tub 20.

A drive shaft 19 is connected to a rear surface of the drum 30 to transmit the power of the drive motor 7. A plurality of through holes 27 are formed in the circumference of the drum 30 for distribution of washing water. A plurality of lifters 26 are installed on an inner circumferential surface of the drum 30 to raise and drop laundry during rotation of the drum 30.

The drive shaft 19 is arranged between the drum 30 and the drive motor 7. One end of the drive shaft 19 is connected to the rear plate of the drum 30, and the other end of the drive shaft 19 extends outward of a rear wall of the tub 20. When the drive motor 7 rotates the drive shaft 19, the drum 30 connected to the drive shaft 19 is rotated about the drive shaft 19.

A bearing housing 8 is mounted to the rear wall of the tub 20 to rotatably support the drive shaft 19. The bearing housing 8 may be formed of an aluminum alloy, and may be inserted into the rear wall of the tub 20 during injection molding of the tub 20. Bearings 9 are interposed between the bearing housing 8 and the drive shaft 19, to assure smooth rotation of the drive shaft 19.

Installed at the bottom of the tub 20 are a drain pump 4 to discharge the water in the tub 20 to the outside of the main body 10, a connection hose 3 connecting the tub 20 to the drain pump 4 such that water in the tub 20 may flow into the drain pump 4, and a drain hose (not shown) that guides water pumped by the drain pump 4 to the outside of the main body 10.

Referring to FIGS. 3 to 5, the door 100 may include a door body 110 provided to correspond to the inlet 11 and an auxiliary door 120 for opening and closing an auxiliary inlet 111 provided in the door body 110.

The door body 110 may be rotatably provided on the main body 10. The door body 110 may include a door frame 112 forming the door body 110 and a door glass 113.

Although the door body 111 is configured in a substantially annular form in the embodiment of the disclosure, the door body 111 may be configured in a substantially rectangular form.

The door glass 113 may be formed of a transparent material for the inside of the drum to be seen from the outside of the washing machine even when the inlet 11 is closed by the door 100. The door glass 113 may be disposed to convexly protrude from the door frame 112 toward the inside of the main body 10. With such a configuration, when the door 100 is closed, the door glass 113 may be provided inward of the inlet 11.

A hinge part 114 is provided at a surrounding of the inlet 11 for the door 100 to be rotated with respect to the main body 10, and is coupled to a hinge coupling part 115 formed at one side of the door body 110. A hook 116 is provided on the other side of the door frame 112, and a hook receiving part 118 is provided on the front panel 10*a* corresponding to the hook 116 such that the inlet 11 remains closed by the door 100.

In order to introduce laundry into the washing machine even when the door 100 is closed, the door 100 is provided with the auxiliary inlet 111. Although the auxiliary inlet 111 is provided on the door body 110 according to the embodiment of the disclosure, the auxiliary inlet may be provided by forming a hole through the door glass 113.

When laundry is introduced into the washing machine through the auxiliary inlet 111 of the door body 110, the laundry needs to pass through the door glass 113. Accordingly, the door glass 113 is provided with a glass through hole 113*a*. Alternatively, the upper portion of the door glass may be recessed such that the door glass is not arranged behind the auxiliary inlet 111.

In order to connect the auxiliary inlet 111 of the door body 110 to the glass through hole 113*a* of the door glass 113, the door body 110 may include a connection guide part 119. The connection guide part 119 may be provided in the shape of a tube that is open at both ends and has a hollow portion.

In detail, the connection guide part 119 is connected at one end thereof to the auxiliary inlet 111 and at the other end thereof to the glass through hole 113*a*. In this embodiment, the connection guide part 119 may be provided sloping downward from the front to the rear. That is, the one end of the connection guide part 119 connected to the auxiliary inlet 111 has a position higher than that of the other end of the connection guide part 119. Such a configuration allows laundry to be easily introduced into the drum 30 through the auxiliary inlet 111.

In order to open and close the auxiliary inlet 111, the auxiliary door 120 is rotatably mounted to the door body 110. The auxiliary door 120 may be formed of a material having heat insulation or heat resistance. When the washing machine has a drying function, the temperature inside the main body 10 may increase, and the auxiliary door 120 formed of a material having heat insulation or heat resistance may prevent the heat inside the main body 10 from being transferred to the outside of the auxiliary door 120.

An elastic gasket 130 is arranged at a portion of the rear side of the auxiliary door 120 that comes in contact with the periphery of the auxiliary inlet 111. The elastic gasket 130 has a shape corresponding to that of the auxiliary inlet 111, and serves to seal a portion between the auxiliary inlet 111 and the auxiliary door 120 in a state in which the auxiliary door 120 closes the auxiliary inlet 111. The elastic gasket 130 may be formed of an elastic material, such as rubber, or may have a structure containing elasticity, such as a tube. Therefore, the auxiliary door 120 in a state of being closed is biased in the opening direction. That is, when a force to maintain the auxiliary door 120 in a closed state disappears, the auxiliary door 120 may be automatically opened by the elastic restoring force of the elastic gasket 130.

On the other hand, the auxiliary door 120 is provided with an auxiliary door hinge part 125 that is installed in an auxiliary door coupling part 117 arranged on the door body 110. Although the auxiliary door 120 is biased in the opening direction by the restoring force of the elastic gasket 130 in the embodiment of the disclosure, an elastic member may be additionally installed in the auxiliary door hinge part 125 to further assure the auto-open function of the auxiliary door 120.

In order to maintain the auxiliary door 120 in a closed state, the door 100 may include a restraining device 200. The restraining device 200 will be described in detail below.

The restraining device 200 is provided to maintain the auxiliary door 120 in a closed state or to lock the auxiliary door 120 so that the auxiliary door 120 is not opened by an external force.

In this case, the maintaining of the auxiliary door 120 in a closed state refers to preventing the auxiliary door 120 from being opened unless an external force is applied, that is, unless a user manipulates the washing machine 1 to open the auxiliary door 120. In this case, the auxiliary door 120 is in a state of being openable when an external force is applied to the auxiliary door 120 or when the washing machine 1 is manipulated.

The locking of the auxiliary door 120 by the restraining device 200 or maintaining of the auxiliary door 120 in a locked state refers to locking the auxiliary door 120 in a closed state by the locking device 200 such that the auxiliary door 120 is not opened even when a user tries to open the auxiliary door 120.

In the disclosure, the term opposite to the locked state of the auxiliary door 120 is expressed as an unlocked state, and when the auxiliary door 120 is in an unlocked state, the auxiliary door 120 may be maintained in a closed state.

That is, the auxiliary door 120 in an unlocked state may be maintained in a closed state so as not to be opened unless receiving an external force, and may be opened when receiving an external force.

In the case of the conventional washing machine without the auxiliary door 120, in order to add laundry during a washing stroke, a procedure of pausing the washing stroke, performing a drainage stroke, performing unlock control of the door, adding laundry, and resuming the washing stroke is performed. In the case of the conventional washing machine including the auxiliary door 120, a procedure of pausing the washing stroke, performing unlock control of the auxiliary door, adding laundry, and resuming the washing stroke is performed.

As such, in the case of the washing machine including the auxiliary door 120, separately from the auxiliary door 120, a locking device for locking and unlocking the auxiliary door 120 when the auxiliary door 120 is in a closed state, an auxiliary door closing detection switch for controlling the locking device, and other electric components electrically connected to the controller of the washing machine may be mounted inside the door.

As the electric components are mounted inside the door to perform locking and unlocking on the auxiliary door or to control the locking and unlocking of the auxiliary door, the connection with the main body is required to transmit an electrical signal to the electric components, and thus wire harness is used to connect the main body to the electric components inside the door through the hinge part of the door.

Accordingly, the structure of the door may be complicated, the number of the manufacturing processes is increased, the manufacturing cost of the door is increased, and the repair or replacement of the door is complicated when the door is broken.

In order to obviate such a limitation, the washing machine 1 according to the embodiment of the disclosure may include the door 100 in which electric components are not arranged.

The restraining device 200 arranged inside the auxiliary door 120 may restrain the auxiliary door 120 to maintain the auxiliary door 120 in a closed state. In this case, the restraining device 200 may be provided such that the door 120 is opened when an external force is applied to the auxiliary door 120.

Referring to FIG. 6, the washing machine 1 may include a locking guide 300 arranged on the main body 10 outside the door 100. The locking guide 300 may guide the restraining device 200 to lock the auxiliary door 120.

As will be described below, the locking guide 300 is provided to press the restraining device 200 to lock or unlock the auxiliary door 120, and thus may be referred to as a pressing device 300. However, in the follow description, the term "the locking guide 300" will be used.

The locking guide 300 may guide the restraining device 200 to lock the auxiliary door 120. That is, the locking guide 300 may allow the auxiliary door 120 to be locked onto the restraining device 200 in association with the restraining device 200.

In a state in which the auxiliary door 120 is locked onto the restraining device 200 by the locking guide 300, the auxiliary door 120 may be prevented from being separated from the restraining device 200 by an external force.

The locking guide 300 allows the restraining device 200 to lock the auxiliary door 120 through physically pressing on the restraining device 200.

In this case, the restraining device 200 may simply lock and unlock the auxiliary door 120 in association with the locking guide 300 without an electrical connection, and the locking guide 300 may guide the restraining device to lock and unlock the auxiliary door 120 through the electrical connection.

That is, the restraining device 200 may lock and unlock the auxiliary door 120 without an electrical connection with the main body 10, and maintain the auxiliary door 120 in a locked state by a physical external force of the locking guide 300 generated from the outside the restraining device 200.

Therefore, the restraining device 200 may omit the conventional wire harness arranged inside the door body 110.

That is, the restraining device 200 may be provided to lock or unlock the auxiliary door 120 through a physical pressing by the locking guide 300 without receiving an electrical signal. Therefore, there is no need to arrange the wire harness inside the door body 110 to transmit an electrical signal to lock or unlock the auxiliary door 120.

As such, separately from the configuration for guiding the restraining device 200, the configuration of the locking guide 300 for guiding the locking and unlocking of the restraining device 200 is arranged inside the main body 10, that is, outside the door 100.

Therefore, the wire harness may be simply connected to the locking guide 300 arranged inside the main body 10 without extending to the inside of the door body 110. Even though the electrical signal is transmitted only to the locking guide 300 connected with the wire harness rather than being transmitted to the restraining device 200, the restraining device 200 may lock or unlock the auxiliary door 120 in association with the locking guide 300.

Hereinafter, the restraining device 220, the locking guide 300, and a door sensor 310 for sensing the opening and closing state of the auxiliary door 120 will be described in detail.

Figure 7:
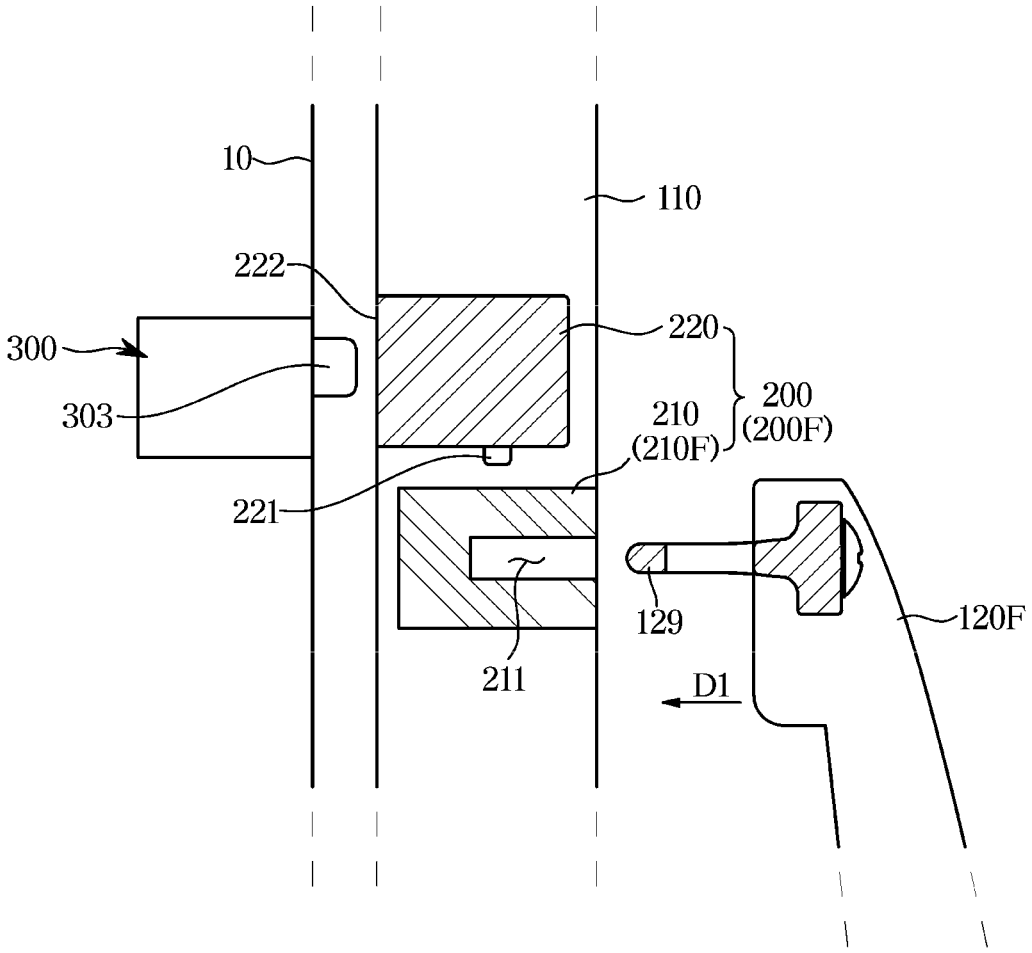
FIG. 7 is a view illustrating a restraining device and a locking guide in a state in which an auxiliary door is open in a washing machine according to an embodiment of the disclosure.
Figure 8:
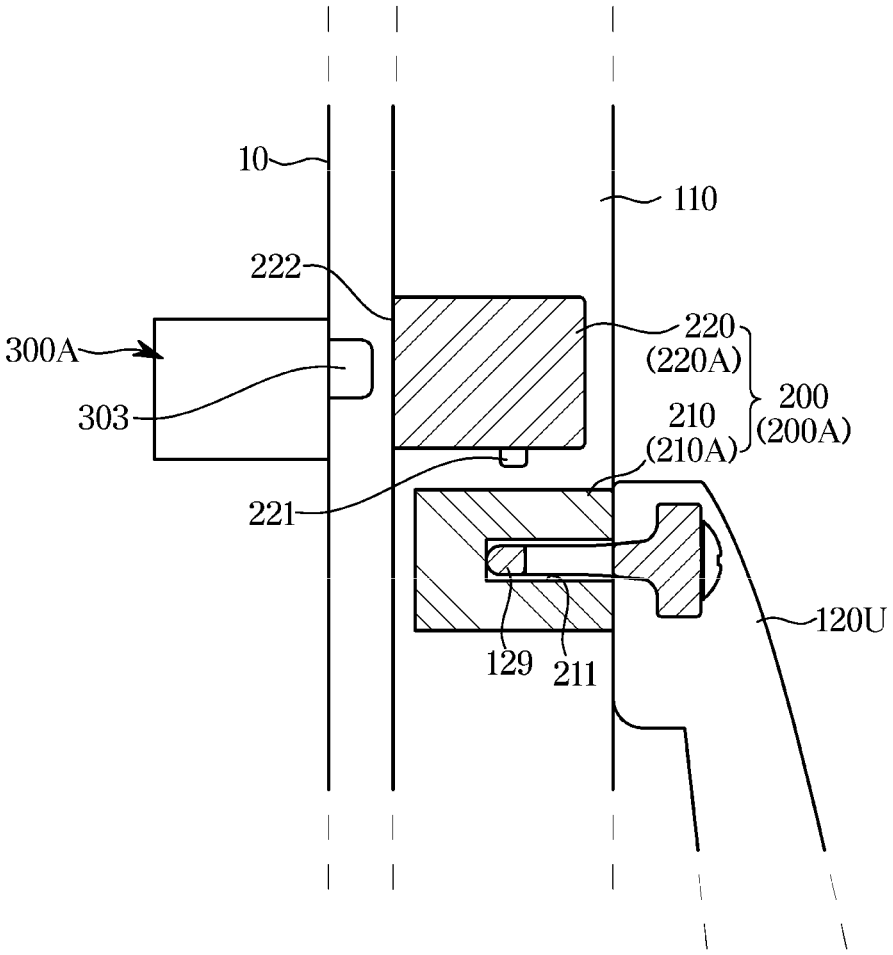
FIG. 8 is a view illustrating a restraining device and a locking guide in a state in which an auxiliary door is closed in a washing machine according to an embodiment of the disclosure.
Figure 9:
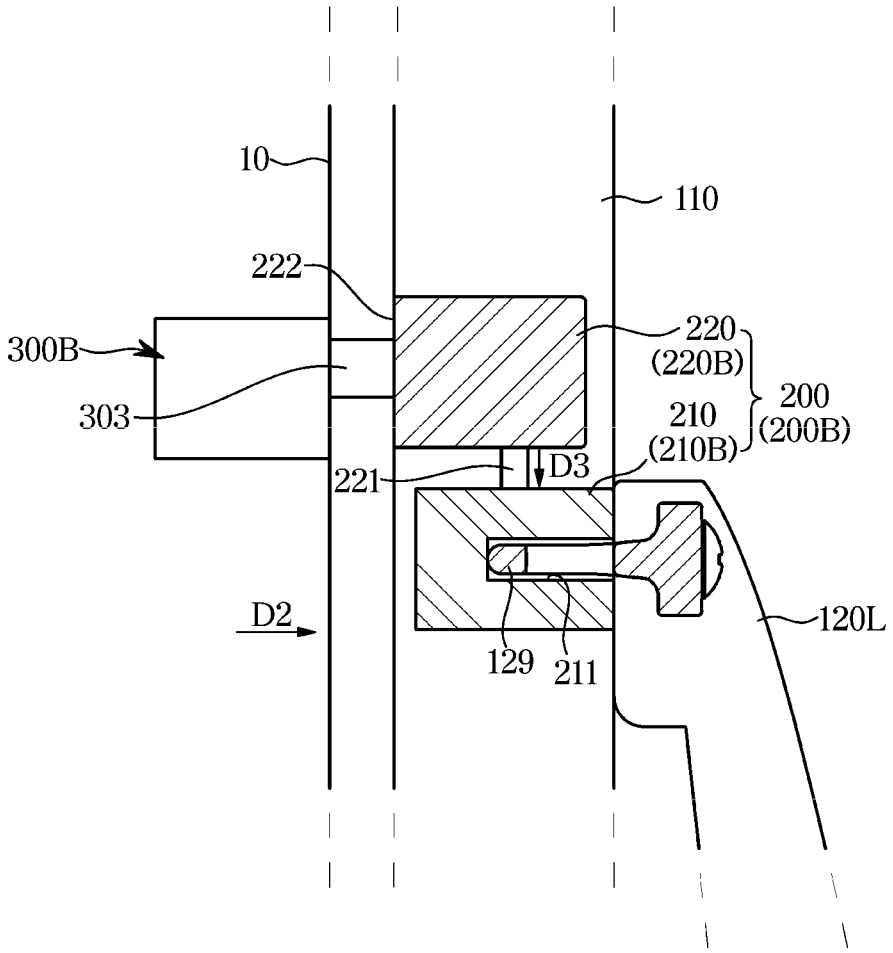
FIG. 9 is a view illustrating a state in which an auxiliary door is locked by a restraining device by a locking guide driven according to an embodiment of the disclosure.

FIG. 6 is a view schematically showing the configuration of a door and a controller according to the first embodiment of the disclosure, FIG. 7 is a view illustrating a restraining device and a locking guide in a state in which an auxiliary door is open in a washing machine according to the first embodiment of the disclosure, FIG. 8 is a view illustrating a restraining device and a locking guide in a state in which an auxiliary door is closed in a washing machine according to the first embodiment of the disclosure, and FIG. 9 is a view illustrating a state in which an auxiliary door is locked by a restraining device by a locking guide driven according to the first embodiment of the disclosure.

Referring to FIG. 6, the washing machine 1 may include a controller 320, the locking guide 300 electrically connected to the controller 320 and guiding the restraining device 200 to lock and unlock the auxiliary door 120, and a door sensor 310 sensing whether the auxiliary door 120 is opened or closed.

As described above, the door 100 is not provided with electric components, and the locking guide 300 guiding the locking and unlocking of the restraining device 200 and the door sensor 310 sensing whether the auxiliary door 120 is opened or closed may be arranged in the main body 10 rather than in the door body 110.

That is, the locking guide 300 and the door sensor 310, which need to be electrically connected to the controller 320 provided inside the main body 10, are arranged inside the main body 10, and the restraining device 200 operating without an electrical signal is arranged on the door body 110. Accordingly, a wire for transmitting an electrical signal may be arranged only inside the main body 10 rather than extending to the door body 110.

Herein, the guiding of locking of the restraining device 200 by the locking guide 300 (300B) refers to a case in which the locking guide 300 guides locking of the restraining device 200 such that the restraining device 200 is set into a locking-maintaining state 200C in which the auxiliary door 120 is not openable even when receiving an external force and the restraining device 200 is able to lock the auxiliary door 120 (see FIG. 9).

On the contrary, the guiding of unlocking of the restraining device 200 by the locking guide 300 (300A) refers to a case in which the locking guide 300 guides unlocking of the restraining device 200 such that the restraining device 200 is set into an unlocking-allowing state 200A in which the restraining device 200 is able to unlock the auxiliary door 120 such that the auxiliary door 120 is openable when receiving an external force (see FIG. 8).

According to the conventional technology, in a state that the auxiliary door 120 is restrained onto the restraining device 200 by a push, when the auxiliary door 120 is pushed again, the restraining of the auxiliary door 120 onto the restraining device 200 may be released by a push latch or the like.

However, according to the disclosure, when the locking guide 300 guides locking of the restraining device 200, the restraining device 200 is set into a locking-maintaining state 200B in which the auxiliary door 120 is not unlocked even when pushed.

On the contrary, when the locking guide 300 guides unlocking of the restraining device 200, the restraining device 200 is set into a unlocking-allowing state 200A in which case the auxiliary door 120 is openable when pressed by the user. This will be described below in detail.

The restraining device 200 is arranged on the door body 110, and configured to restrain the auxiliary door 120 when at least a portion of the auxiliary door 120 is inserted into the restraining device 200 through rotation of the auxiliary door 120. In addition, the restraining device 200 may lock the auxiliary door 120 in association with the locking guide 300 arranged inside the main body 10.

Referring to FIG. 7, the auxiliary door 120 may include an insertion portion 129 that is inserted into the restraining device 120 through rotation of the auxiliary door 120 such that the auxiliary door 120 is maintained in a closed state.

The restraining device 200 may include a first restraining part 210 allowing the insertion portion 129 to be inserted therein and restraining the inserted insertion portion 129.

The first restraining part 210 may include an insertion groove 211 into which the insertion portion 129 is inserted. When the insertion portion 129 is inserted into the insertion groove 211, the first restraining part 210 may restrain the insertion portion 129 through a restraining member (not shown). The restraining member (not shown) may be provided as a configuration, such as a hook, a latch, and the like. In addition, the first restraining part 210 may be provided as a push latch, but is not limited thereto.

The restraining device 200 may include a second restraining part 220 provided to restrain the first restraining part 210.

The second restraining part 220 may restrain the first restraining part 210 in association with the locking guide 300. The second restraining part 220 may selectively restrain the first restraining part 210 or release the restraining of the first restraining part 210 by the locking guide 300.

The restraining of the first restraining part 210 by the second restraining part 220 refers to a state in which the auxiliary door 120 is maintained in a state of being restrained onto the first restraining part 210 and the restraining of the auxiliary restraining door 120 by the first restraining part 210 is not released even with an external force. Accordingly, when the second restraining part 220 restrains the first restraining part 210, the auxiliary door 120 may be set into a locked state.

On the contrary, when the restraining of the first restraining part 210 by the second restraining part 220 is released, the auxiliary door 120 may be maintained in a state of being restrained onto the first restraining part 210, but in response to receiving an external force, the restraining of the auxiliary door 120 by the first restraining part 210 may be released. Accordingly, when the second restraining part 220 does not restrain the first restraining part 210, the auxiliary door 120 may be set into an unlocked state.

The locking guide 300 may be provided to press the second restraining part 220 arranged in the door body 110 from the main body 10 such that the second restraining part 220 restrains the first restraining part 210.

On the contrary, the locking guide 300 may not press the second restraining part 220 such that the second restraining part 220 does not restrain the first restraining part 210.

The second restraining part 220 may include a pressing surface 222 that is pressed by the locking guide 300. The pressing surface 222 of the second restraining part 220 may be provided at a rear end of the door frame 112.

In detail, the door frame 112 is provided on the rear surface thereof with a cut-out region through which the pressing surface 222 is exposed to the outside, and the pressing surface 222 is arranged in the cut-out region on the rear surface of the door frame 112 (see FIG. 5).

As such, the pressing surface 222 may be provided to be exposed to the outside, so that the locking guide 300 arranged in the main body 10 may press the pressing surface 222 from the outside of the door 100.

The pressing surface 222 may be arranged at an approximately same height as that of the locking guide 300 when the door 100 is closed, and arranged in an approximately same line with the locking guide 300 in the front-rear direction.

The insertion portion 129 may be arranged at a rear end of an upper part 122 of an auxiliary door frame 121 of the auxiliary door 120 (See FIGS. 3 and 4).

The auxiliary door 120 in an open state rotates about the auxiliary door hinge part 125 such that the upper part 122 of the auxiliary door frame 121 is arranged adjacent to the door body 110, and additionally rotates such that the insertion portion 129 is inserted into the first restraining part 210 and thus the auxiliary door 120 is coupled to the door body 110, causing the auxiliary door 120 to be set into a closed state.

The locking guide 300 may be electrically connected to the controller 320 to press the pressing surface 222 under the control of the controller 320.

The locking guide 300 may include a push rod 303 that is movable in the front and rear directions and a rod driver 301 for driving the push rod 303. The rod driver 301 may generate a rotational force through a configuration, such as a motor, and may generate a rotational force in one direction or the other direction by receiving a signal from the controller 320.

Although not shown, the locking guide 300 may include a transmission part (not shown) arranged between the push rod 303 and the rod driver 301 and transmitting a rotational force generated by the rod driver 301 to the push rod 303.

The transmission part (not shown) may include a gear or the like, and may convert the rotational force transmitted from the rod driver 301 such that the push rod 303 moves linearly.

Accordingly, the push rod 303 is movable in a second direction D2 that is the forward direction when the rod driver 301 rotates in one direction, and is movable in a first direction D1 that is the rearward direction when the push rod 303 rotates in the opposite direction.

Therefore, the rod driver 301 may allow the push road 303 to be selectively protruded in response to receiving a signal from the controller 320 to press the push surface 222.

As described above, since the locking guide 300 is arranged inside the main body 10, the push rod 303 may be protruded from the inside of the main body 10 to the pressing surface 222 by passing through a rod through hole 304 formed in the front panel 10*b*.

As described above, the auxiliary door 120 in an unlocked state may be easily opened and closed with respect to the restraining device 200 by the pressing of the user in an unlocked state. However, when the auxiliary door 120 is rendered unlocked during the washing stroke of the washing machine 1, a safety accident may occur. For the auxiliary door 120 may be arbitrarily opened by an external force during the washing stroke of the washing machine 1.

Therefore, before the washing stroke starts, the controller 320 may control the locking guide 300 to guide locking of the restraining device 200 (300B) (See FIG. 9)

Accordingly, during a washing stroke of the washing machine 1, the auxiliary door 120 is maintained in a locked state 120L even when the user presses the auxiliary door 120 so that the auxiliary door 120 may not be opened.

Thereafter, when the auxiliary door 120 needs to be unlocked to additionally introduce laundry into the drum 30, the user may input an unlocking signal for the auxiliary door 120 to the controller 320 through the inputters (81*a* and 81*b* in FIG. 1).

Accordingly, the controller 320 may control the locking guide 300 to guide unlocking of the restraining device 200 (300A).

Accordingly, the restraining device 200 may allow the auxiliary door 200 to be set into the unlocking-allowing state 200A in which the restraining of the auxiliary door 120 onto the restraining device 200 is released when an external force is applied.

Therefore, the user may open the auxiliary door 120 by pressing the auxiliary door 120 and may additionally introduce laundry into the drum 30 without opening the door body 110. The locking guide 300B and the unlocking guide 300A of the restraining device 200 by the locking guide 300 will be described below in detail.

Referring to FIG. 7, when the auxiliary door 120 is in an open state 120F, the restraining device 200 is in a first state 200F. The first state 200F of the restraining device 200 is a state in which the insertion portion 129 is not inserted into the insertion groove 211 of the first restraining part 210 and thus the first restraining part 210 does not restrain the auxiliary door 120.

As will be described below, the second restraining part 220 includes a fixing member 221 inserted into the first restraining part 210 to restrain the first restraining part 210. In the first state 200F of the restraining device 200, the fixing member 221 is not inserted into the first restraining part 210 and thus is incapable of fixing the first restraining part 210.

The first restraining part 210 may lock the auxiliary door 120 in association with the fixing member 221. That is, with the fixing member 221 inserted into the first restraining part 210, the first restraining part 210 may hold the insertion portion 129 restrained even when receiving an external force.

Although not shown, the first restraining part 210 may include a stopper (not shown). In the first state 200F of the restraining device 200, the stopper (not shown) may prevent the fixing member 221 from being inserted into the first restraining part 210.

Such a state in which the second restraining part 220 is incapable of restraining the first restraining part 210 may be defined as a first state 210F of the first restraining part 210.

In the first state 210F of the first restraining part 210, the fixing member 221 is not inserted into the first restraining part 210 and thus the first restraining part 210 is incapable of locking the auxiliary door 120.

However, the disclosure is not limited thereto, and the first restraining part 210 may not include a stopper (not shown) and the fixing member 221 may be inserted into the first restraining part 210 when pressed by the locking guide 300.

The auxiliary door 120 may move in the first direction D1, and in association with the movement, the insertion portion 129 may be inserted into the insertion groove 211.

Referring to in FIG. 8, the first restraining part 210 may restrain the insertion portion 129 in association with the insertion of the insertion portion 129. The first restraining part 210, into which the insertion portion 129 is inserted, may hold the insertion portion 129 restrained unless receiving an external force.

However, in response to receiving an external force applied by a user pressing the auxiliary door 120, the first restraining part 210 may release the restraining of the insertion portion 129 in association with the external force.

That is, when an external force is transmitted to the first restraining part 210 into which the insertion portion 129 is inserted, the insertion portion 129 is separated from the first restraining part 210, thereby causing the auxiliary door 120 to be set into an open state 120F.

When the insertion portion 129 is inserted into the insertion groove 211, the restraining device 200 may be set into a second state 200A. The second state 200A is a state in which the second restraining part 220 does not restrain the first restraining part 210.

When the second restraining part 220 restrains the first restraining part 210, the insertion portion 129 may be prevented from being separated from the insertion groove 211 due to an external force. On the contrary, when the second restraining part 220 does not restrain the first restraining part 210 (i.e., the second state 200A), the insertion portion 129 may be separated from the insertion groove 211 when the external force is applied to the first restraining part 210.

That is, in the second state 200A of the restraining device 200, the auxiliary door 120 may be maintained in a closed state while being restrained onto the restraining device 200. However, the auxiliary door 120 may be restrained onto the restraining device 200 in an unlocking state 120U in which the auxiliary door 120 may be separated from the restraining device 200 by an external force and then opened.

The first restraining part 210, in association with the insertion of the insertion portion 129, may be set into a second state 210A in which the first restraining part 210 is fixable by the fixing member 221. The first restraining part 210 may be provided to have the fixing member 221 inserted thereinto in response to having the insertion portion 129 inserted thereinto. Although not shown, the configuration may be implemented in a variety of forms.

For example, the stopper (not shown) may be located at a position to restrict the movement of the fixing member 221 so that the fixing member 221 is prevented from being inserted into the first restricting part 210 when the first restraining part 210 is in the first state 210F. However, when the first restraining part 210 is in the second state 210A, the stopper may be moved to a position not to restrict the movement of the fixing member 221 in association with the insertion of the insertion portion 129.

In this case, the fixing member 221 may be inserted into the first restraining part 210, so that the second restraining part 220 may restrain the first restraining part 210.

When the first restraining part 210 is in the second state 210A, the second restraining part 220 may selectively restrain the first restraining part 210. The second restraining part 220 without being pressed by the locking guide 300 may be set into a first state 220A in which the second restraining part 220 does not restrain the first restraining part 210.

When the restraining device 200 is in the first state 200F or the second state 200A, the second restraining part 220 may be maintained in the first state 220A. However, when pressed by the locking guide 300, the second restraining part 220 may be switched to the second state 220B in which the second restraining part 220 restrains the first restraining part 210.

That is, the restraining device 200 in the second state 200A restrains the auxiliary door 120 in an unlocked state, but when the locking guide 300 is driven, the restraining device 200 may be switched to a state of being capable of locking the auxiliary door 120 in association with the locking guide 300.

When the locking guide 300 is driven by the controller 320, the push rod 303 may be protruded in the second direction D2 as shown in FIG. 9.

The controller 320 may control the locking guide 300 such that the push rod 303 of the locking guide 300 is protruded when the stroke of the washing machine 1 is started or when the stroke is paused and then resumed by a user input.

In this case, the controller 320 may control the locking guide 300 not to protrude the push rod 303 when the closing of the auxiliary door 120 is not detected by the door sensor 310 or a protruding length of the push rod 303 is detected to be less than a predetermined value by a detecting sensor 305 of the locking guide 300, which will be described below.

When the locking guide 300 presses the second restraining part 220 in the second direction D2, the second restraining part 220 may allow the fixing member 221 to slide in a third direction D3, that is, in the lower side direction, in association with the pressing of the second restraining part 220.

The sliding of the fixing member 221 in the third direction D3 in association with the pressing of the push rod 303 may be implemented in a variety of configurations.

For example, the pressing surface 222 may be provided with an insertion hole into which the push rod 303 is inserted, and the push rod 303 inserted into the inner side of the pressing surface 222 may cause the fixing member 221 to be pressed. In this case, the fixing member 221 may be protruded in the third direction D3 through the guide. In addition, when the push rod 303 presses the pressing surface 222, the second restraining part 220 may be moved in the second direction D2, which is the pressing direction of the push rod 303, and the fixing member 221 may be moved in the third direction D3 along the guide in association with the movement of the second restraining part 220.

As the fixing member 221 is moved downward, the fixing member 221 may be inserted into the first restraining part 210. The state of the first restraining part 210 in which the fixing member 221 is inserted into the first restraining part 210 may be defined as a third state 210B of the first restraining part 210.

The first restraining part 210 in the third state 210B is linked to the fixing member 221, and thus even when receiving an external force, may allow the insertion portion 129 to be restrained without being separated from the first restraining part 210.

While the first restraining part 210 in the second state 210A is provided to release the restraining of the insertion portion 129 by receiving an external force, the first restraining part 210 in the third state 210B may hold the restraining of the insertion portion 129 even when receiving an external force.

That is, when the first restraining part 210 is in the third state 210B, the restraining device 200 may lock the auxiliary door 120. When the first restraining part 210 is in the third state 210B, the auxiliary door 120 may be restrained onto the restraining device 200 in the locking state 120L.

As such, a state in which the first restraining part 210 is linked to the fixing member 221 and thus even when receiving an external force, holds the restraining of the insertion portion 129 may be defined as the third state 200B of the restraining device 200.

As the fixing member 221 fixes the first restraining part 210, the second restraining part 220 restrains the first restraining part 210, and thus the auxiliary door 120 is not unlockable from the restraining device 200 even by an external force, which is referred to as the third state 300B of the restraining device 200.

In the third state 200B of the restraining device 200, even when the user presses the auxiliary door 120 in the first direction D1, the auxiliary door 120 is not opened and is restrained onto the restraining device 20 in the locking state 120L.

The locking guide 300 may guide the locking of the restraining device 200 (300B) such that the second restraining part 220 restrains the first restraining part 210 and thus the restraining device 200 locks the auxiliary door 120.

When a state in which the second restraining portion 220 is pressed by the locking guide 300 so that the fixing member 221 is moved in the third direction D3 is defined as the second state 220B, the locking guide 300 may switch the second restraining part 220 from the first state 220A to the second state 220B through the push rod 303.

When the second restraining part 220 is switched to the second state 220B, the fixing member 221 is lowered to be inserted into the first restraining part 210, so that the first restraining part 210 is set into the third state 210B. When the first restraining part 210 is set into the third state 210B, the restraining device 200 may lock the auxiliary door 120.

That is, the restraining device 200 guided by the locking guide 300 may lock the auxiliary door 120. In other words, the restraining device 200 may lock the auxiliary door 120 in association with the locking guide 300.

When the push rod 303 is kept protruded, the pressing surface 222 of the second restraining part 220 is kept pressed, so that the fixing member 221 is kept inserted into the first restraining part 210.

When the pressing surface 222 is kept pressed by the protruding push rod 303, the locking guide 300 may guide the restraining device 200 to maintain a locking state of the restraining device 200 on the auxiliary door 120.

As such, the guiding of locking of the restraining device 200 by the locking guide 300 such that the restraining device 200 is set into the third state 200B is referred as a locking guide 300B.

On the contrary, when the push rod 303 is retracted and the pressing on the pressing surface 222 is terminated, the locking guide 300 may guide the restraining device 200 to unlock the auxiliary door 120. The guiding of unlocking of the restraining device 200 by the locking guide 300 may be defined as an unlocking guide 300A.

That is, when the pressing of the locking guide 300 in the third state 200B of the restraining device 200 is terminated, the locking guide 300 may perform the unlocking guide 300A on the restraining device 200 to unlock the auxiliary door 120. Accordingly, the state of the restraining device 200 may be switched from the third state 200B to the second state 200A.

When the controller 320 controls the locking guide 300 such that the push rod 303 retracts, the pressing on the pressing surface 222 is released and thus in association with the release of the pressing, the second restraining part 220 may have the fixing member 221 return to its original position.

In this case, the fixing member 221 may be moved in the opposite direction to the third direction D3 in association with the movement of the second restraining part 220, and thus may be separated from the first restraining part 210.

As the fixing member 221 is separated from the first restraining part 210, the first restraining part 210 may be switched from the third state 210B to the second state 210A. Thereafter, when the user presses the auxiliary door 120 in the first direction D1, the auxiliary door 120 may be separated from the restraining device 200 and the auxiliary door 120 may be opened.

As such, the locking guide 300 may switch the restraining device 200 into the second state 200A or the third state 200B. The locking guide 300 may perform the locking guide 300B such that the restraining device 200 locks the auxiliary door 120, and on the contrary, may perform the unlocking guide 300A such that the restraining device 200 unlocks the auxiliary door 120.

The locking guide 300 may allow the push rod 303 to be protruded in the second direction D2 to press the second restraining part 220, so that the restraining device 200 is subject to the locking guide 300B. When the push rod 303 is kept protruded, the locking state of the restraining device 200 on the auxiliary door 120 may be maintained.

The locking guide 300 may allow the push rod 303 to be retracted backward in the first direction D1 to terminate the pressing on the second restraining part 220, so that the restraining device 200 is subject to the unlocking guide 300A.

As the push rod 303 is retracted, the restraining device 200 with respect to the auxiliary door 120 may be switched from the locking state of the unlocking state.

Hereinafter, a restraining device 400 according to the second embodiment of the disclosure will be described. Components except for the restraining device 400 described below are the same as those of the washing machine 1 according to the first embodiment of the disclosure, and thus details of thereof will be omitted.

Figure 10:
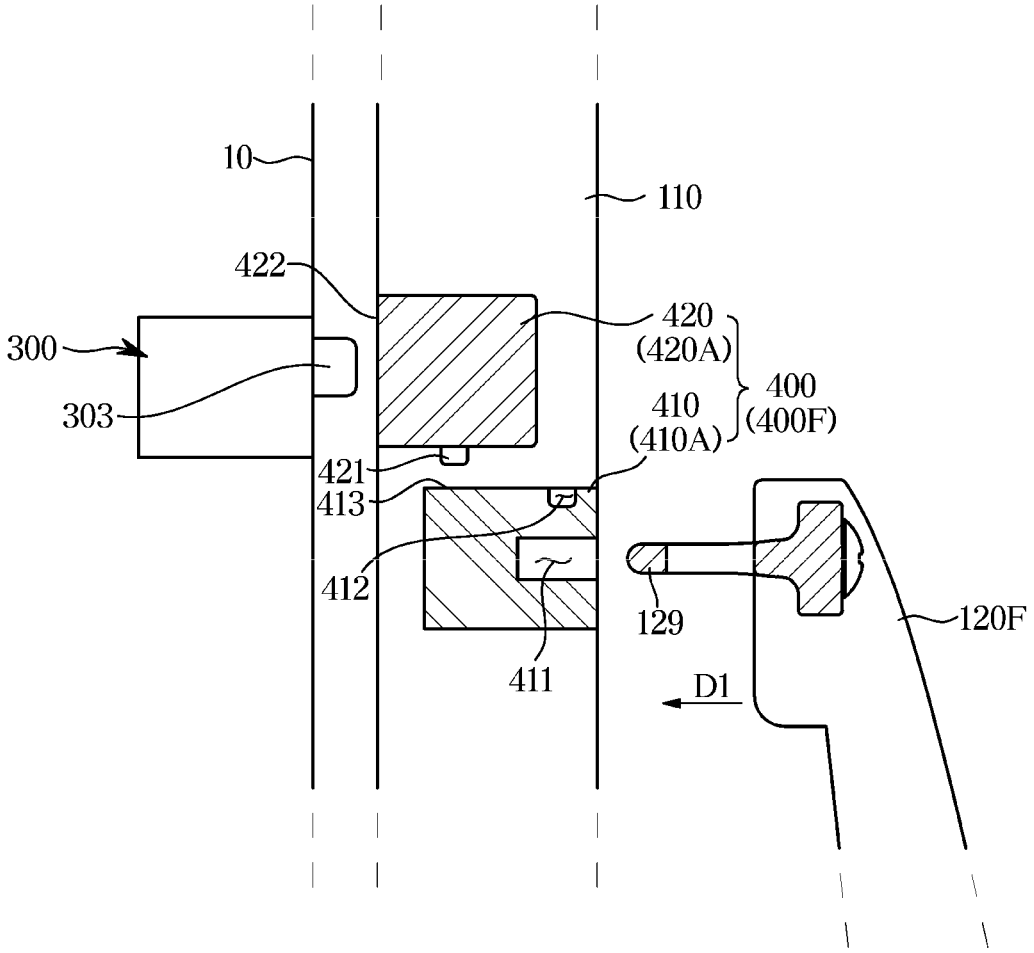
FIG. 10 is a view illustrating a restraining device and a locking guide in a state in which an auxiliary door is open in a washing machine according to an embodiment of the disclosure.
Figure 11:
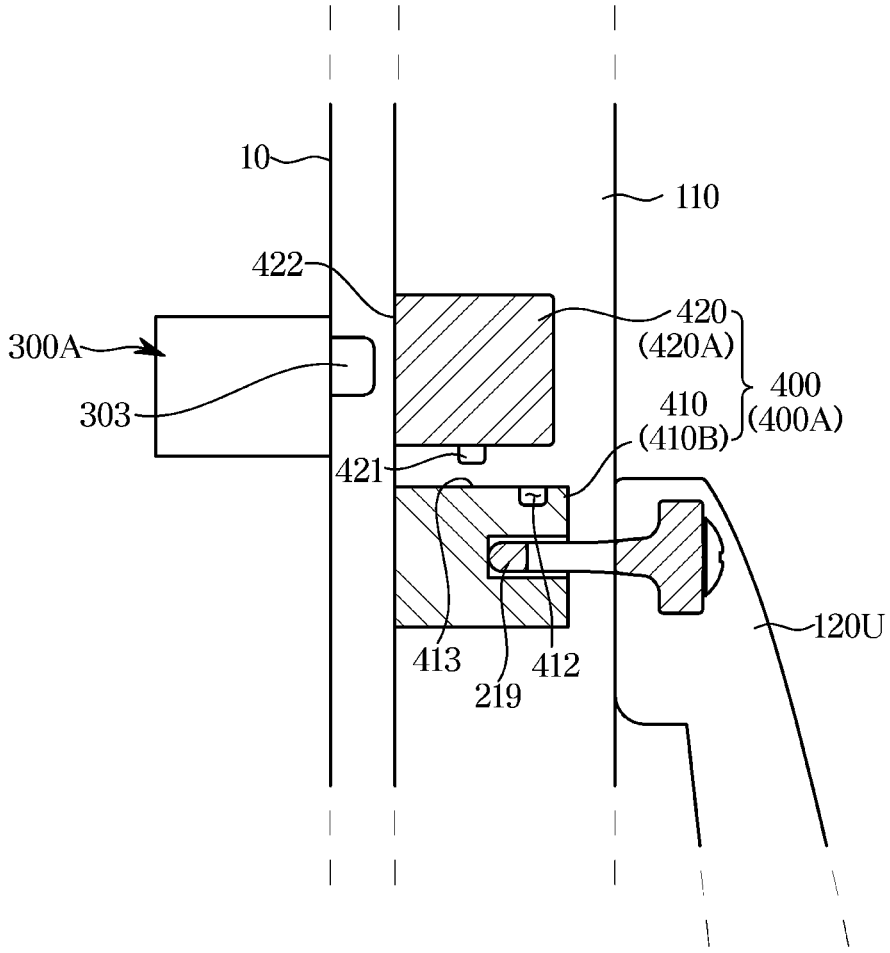
FIG. 11 is a view illustrating a restraining device and a locking guide in a state in which an auxiliary door is closed in a washing machine according to an embodiment of the disclosure.
Figure 12:
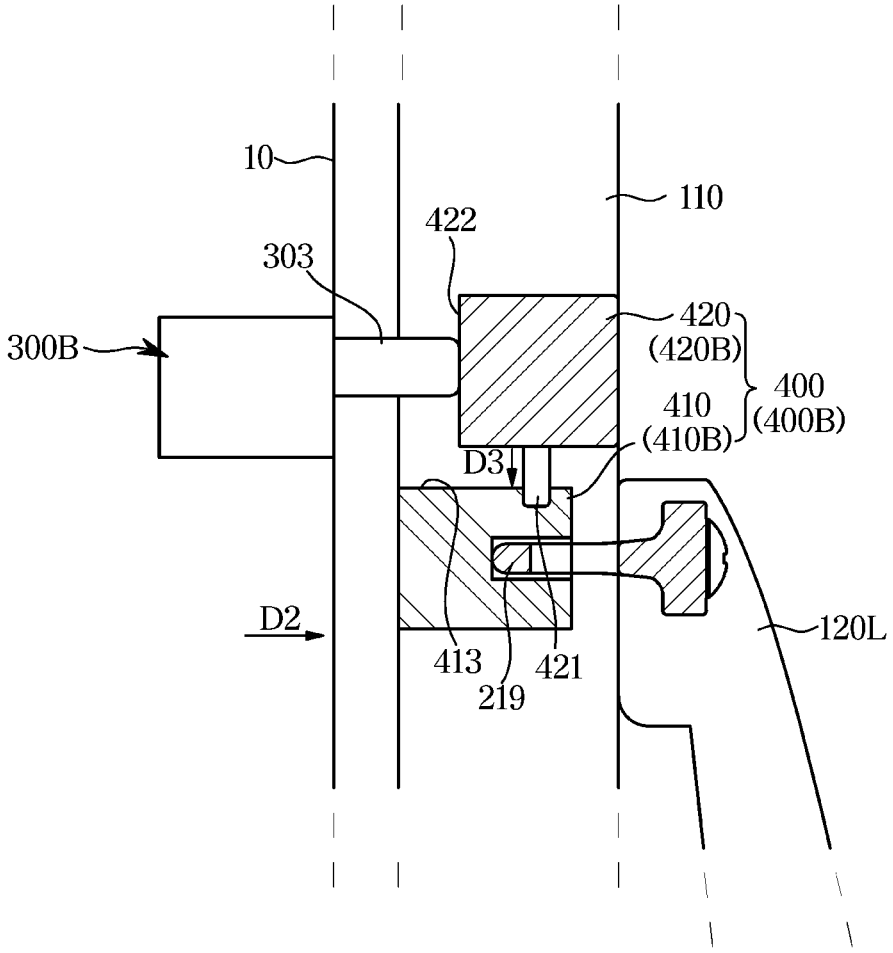
FIG. 12 is a view illustrating a state in which an auxiliary door is locked by a restraining device through a locking guide driven according to an embodiment of the disclosure.

FIG. 10 is a view illustrating a restraining device and a locking guide in a state in which an auxiliary door is open in a washing machine according to the second embodiment of the disclosure, FIG. 11 is a view illustrating a restraining device and a locking guide in a state in which an auxiliary door is closed in a washing machine according to the second embodiment of the disclosure, and FIG. 12 is a view illustrating a state in which an auxiliary door is locked by a restraining device through a locking guide driven according to the second embodiment of the disclosure.

The restraining device 400 may include a first restraining part 410 that is provided to be movable in the first direction D1 that the insertion portion 129 is inserted, and while moving in the first direction D1 in association with the insertion of the insertion portion 129, restrains the insertion portion 129.

The restraining device 400 may include a second restraining part 420 that is provided to be movable in the second direction D2, and while moving in the second direction D2 in association with the locking guide 300, restrains the first restraining part 410.

The second restraining part 420 may be arranged above the first restraining part 410. However, the disclosure is not limited thereto, and the positions of the first restraining part 410 and the second restraining part 420 may be interchanged.

In addition, although not shown in the drawings, the restraining device 400 may include a restraining member (not shown) that temporarily restrains the first restraining part 410 when the first restrainer 410 is moved a predetermined distance in the first direction D1, and in response to an external force in the first direction D1 applied to the first restraining part 410 in a state of being temporarily restrained, releases the restraining of the first restraining part 410.

The second restraining part 420 includes a pressing surface 422 that is pressed in the second direction D2 by the locking guide 300 and a fixing member 421 that fixes the first restraining part 410 in association with the movement of the second restraining part 420.

In addition, although not shown in the drawing, the restraining device 400 may include an elastic member (not shown) that presses a side opposite to the pressing surface 422, and when the locking guide 300 does not press the second restraining part 420, elastically presses the second restraining part 420 in the first direction D1.

The fixing member 421 may be moved downward in association with the second restraining part 420 pressed by the locking guide 300 and moved in the second direction D2. On the contrary, when the pressing of the locking guide 300 is terminated and the second restraining part 420 is moved in the first direction D1, the fixing member 421 may be moved upward in association therewith.

When the fixing member 421 is moved downward, the fixing member 421 may be inserted into the first restraining part 410, and the inserted fixing member 421 may prevent the first restraining part 410 from being separated from a fixed position.

Referring to FIG. 10, when the auxiliary door 120 is placed in the open state 120F, the first restraining part 410 may be placed at a first position 410A.

In addition, the second restraining part 420 may be placed at a third position 420A. A state in which the first restraining part 410 is placed at the first state 410A and the second restraining part 420 is placed at the third position 420A is defined as a first state 400F of the restraining device 400.

Although not shown in the drawing, the first restraining part 410 and the second restraining part 420 may be maintained at the first position 410A and the third position 420A, respectively, through an elastic member or the like.

The first restraining part 410 may include a block area 413 that restricts the fixing member 421 from sliding toward the first restraining part 410 and an insertion area 412 that allows the fixing member 421 to be inserted thereinto by sliding toward the first restraining part 410 such that the first restraining part 410 is fixed by the second restraining part 420.

When the auxiliary door 120 is arranged in the open state 120F, the fixing member 420 may be arranged vertically in line with the block area 413.

That is, the block area 413 is arranged vertically in line with the fixing member 421 to prevent the fixing member 421 from sliding toward the first restraining part 410 when the first restraining part 410 and the second restraining part 420 are placed at the first position 410A and the third position 420A, respectively.

As described above, the block area 413 is an area for blocking the fixing member 421 from sliding downward. When the auxiliary door 120 is in the open state 120F, the fixing member 421 is incapable of sliding toward the first restraining part 410 and thus in capable of fixing the first restraining part 410. Therefore, the second restraining part 420 may not restrain the first restraining part 410.

In this case, even when the locking guide 300 presses the pressing surface 422, the fixing member 421 may not slide downward due to the block area 413, and the second restraining part 420 may not restrain the first restraining part 410 even when pressed by the locking guide 300.

As will be described below, when the locking guide 300 presses the pressing surface 422, the second restraining part 420 is moved from the third position 420A to a fourth position 420B, and the fixing member 421 may slide downward from the fourth position 420B of the second restraining part 420.

In this case, the block area 413 of the first restraining part 410 may be arranged at a position where the fixing member 421 slides in the vertical direction.

Therefore, even when the second restraining part 420 is placed at the third position 420A or the fourth position 420B with the first restraining part 410 placed at the first position 410A, the fixing member 421 may not be inserted toward the first restraining part 410.

That is, when the first restraining part 410 is placed at the first position 410A, the second restraining part 420 may not restrain the first restraining part 420 even with change of position thereof.

As such, when the restraining device 400 is in the first state 400F, the locking guide 300 may not perform the locking guide on the restraining device 400 such that the restraining device 400 locks the auxiliary door 120.

Thereafter, the user may press the auxiliary door 120 such that the insertion portion 129 is inserted into an insertion groove 411 of the first restraining part 410 in the first direction D1. In this case, as illustrated in FIG. 11, the first restraining part 410 may be pressed by the insertion portion 129 and thus placed at the second position 410B.

The first restraining part 410, moving in the first direction D1, may restrain the insertion portion 129, so that the auxiliary door 120 may be set into a closed state.

However, in this state, since the second restraining part 420 does not restrain the first restraining part 410, the auxiliary door 120 may be separated from the restraining device 400 when the user presses the auxiliary door 120 in the first direction D1 again.

A state in which the auxiliary door 120 is closed onto the restraining device 400 in the unlocking state 120U without being locked onto the restraining device 400 so as to be opened by an external force may be defined as the second state 200A of the restraining device 400.

That is, the second state 200A of the restraining device 400 is a state in which the auxiliary door 120 is restrained onto the first restraining part 410 but the first restraining part 410 is not restrained by the second restraining part 420 because the locking guide 300 does not press the second restraining part 420.

In the second state 400A of the restraining device 400, the auxiliary door 120 may be held restrained when no external force, but the restraining of the auxiliary door 120 may be released from the restraining device 400 when an external force occurs.

In the second state 400A of the restraining device 400, when an external force does not occur, the first restraining part 410 may not depart from the second position 410B and the auxiliary door 120 may be held restrained.

However, when the user presses the auxiliary door 120 in the first direction D1, the first restraining part 410 may depart from the second position 410B and move back to the first position 410A.

As the first restraining part 410 returns to the first position 410A, the restraining of the insertion portion 129 by the first restraining part 410 is released, and the auxiliary door 120 is separated from the restraining device 400, so that the auxiliary door 120 may be opened.

That is, in the second state 400A of the restraining device 400, the first restraining part 410 may move between the first position 410A and the second position 410B without restriction, so that opening and closing of the auxiliary door 120 may be selectively achieved by an external force.

However, with the first restraining part 410 arranged at the second position 410B, when the second restraining part 420 is arranged at the fourth position 420B by the locking guide 300, the second restraining part 420 may restrain the first restraining part 410. That is, when the locking guide 300 is driven in the second state 400A of the restraining device 400, the restraining device 400 may be switched to a state of capable of locking the auxiliary door 120.

The restraining device 400 in the second state 400A restrains the auxiliary door 120 in an unlocked state, but when the locking guide 300 is driven, is switched to a state of capable of locking the auxiliary door 120 in association with the locking guide 300.

The locking guide 300 is driven by the controller 320 so that the push rod 303 may be protruded in the second direction D2 as shown in FIG. 12.

The controller 320 may control the locking guide 300 so that the push rod 303 of the locking guide 300 is protruded when the stroke of the washing machine 1 is started or when the stroke is paused and then is restarted by a user's input.

In this case, the controller 320 may control the locking guide 300 not to protrude the push rod 303 when the closing of the auxiliary door 120 is not detected by the door sensor 310 or a protruding length of the push rod 303 is detected to be less than a predetermined value by the detecting sensor 305 of the locking guide 300, which will be described below.

When the locking guide 300 presses the second restraining part 420 in the second direction D2, the second restraining part 420 may be moved in the second direction D2 and the fixing member 421 slides in the lower side direction D3 in association with the pressing of the second restraining part 420.

As the first restraining part 410 is arranged at the second position 410B and the second restraining part 420 is arranged at the fourth position 420B, the fixing member 421 and the insertion area 412 may be arranged vertically in line with each other. Accordingly, the fixing member 421 is movable in the downward direction D3.

When the locking guide 300 is driven and the push rod 303 is protruded, the fixing member 421 may be inserted into the insertion area 412 in connection with the movement of the second restraining part 420.

When the fixing member 421 is slid in the downward direction D3, the fixing member 421 may be inserted into the insertion area 412 to thereby fix the first restraining part 410.

Accordingly, even when an external force is transmitted to the first restraining part 410 in the first direction D1, the first restraining part 410 is prevented from departing from the second position 410B due to the fixing member 421. Therefore, even when an external force is transmitted to the first restraining part 410 in the first direction D1, the first restraining part 410 may maintain the auxiliary door 120 in a locked state.

In detail, when the controller 320 controls the locking guide 300 so that the push rod 303 is protruded in the second direction D2, the push rod 303 may press the pressing surface 422.

In this case, the second restraining part 420 may be moved in the second direction D2 by the pressing of the pressing surface 422 to be placed at the fourth position 420B. When the push rod 303 is kept protruded, the pressing surface 422 of the second restraining part 420 is continuously pressed so that the second restraining part 420 is continuously arranged at the fourth position 420B without departing from the fourth position 420B.

That is, the locking guide 300 may guide the restraining device 400 to lock the auxiliary door 120 by protruding the push rod 303. When the pressing surface 222 is kept pressed by the protruding push rod 303, the locking guide 300 may guide the restraining device 400 to maintain a locking state of the restraining device 400 with respect to the auxiliary door 120.

As such, the state in which the restraining device 400 locks the auxiliary door 120 may be defined as a third state 400B, and the guiding of locking of the restraining device 400 by the locking guide 300 may be defined as locking guide 300B.

That is, as the fixing member 421 fixes the first restraining part 410, the second restraining part 420 restrains the first restraining part 410, and thus the auxiliary door 120 is not unlockable from the restraining device 400 even with an external force, which is referred to as the third state 400B of the restraining device 400.

On the contrary, when the push rod 303 is retracted and the pressing on the pressing surface 422 is terminated, the locking guide 300 may guide the restraining device 400 to unlock the auxiliary door 120. The guiding of unlocking of the restraining device 400 by the locking guide 300 may be defined as unlocking guide 300A.

That is, when the pressing of the locking guide 300 in the third state 400B of the restraining device 400 is terminated, the locking guide 300 may perform the unlocking guide 300A on the restraining device 400 to unlock the auxiliary door 120. Accordingly, the state of the restraining device 400 may be switched from the third state 400B to the second state 400A.

When the controller 320 controls the locking guide 300 such that the push rod 303 retracts, the pressing on the pressing surface 422 is released and thus, the second restraining part 420 may return to the third position 420A.

In this case, the fixing member 421 may be moved in the opposite direction to the third direction D3 in association with the movement of the second restraining part 420, and thus may depart from the insertion area 412.

As the fixing member 421 departs from the insertion are 412, the first restraining part 410 may again move between the second position 410B and the first position 410A without restriction, so that the restraining device 400 may be switched into the second state 400A again.

Thereafter, when the user presses the auxiliary door 120 in the first direction D1, the first restraining part 410 departs from the second position 410B to the first position 410A, so that the auxiliary door 120 is separated from the restraining device 400 and the restraining device 400 is switched to the first state 400F in which the restraining device 400 is incapable of being pressed by the locking guide 300.

Hereinafter, a restraining device 500 according to the third embodiment of the disclosure will be described. Components except for the restraining device 500 described below are the same as those of the washing machine 1 according to the second embodiment of the disclosure, and details of thereof will be omitted.

Figure 13:
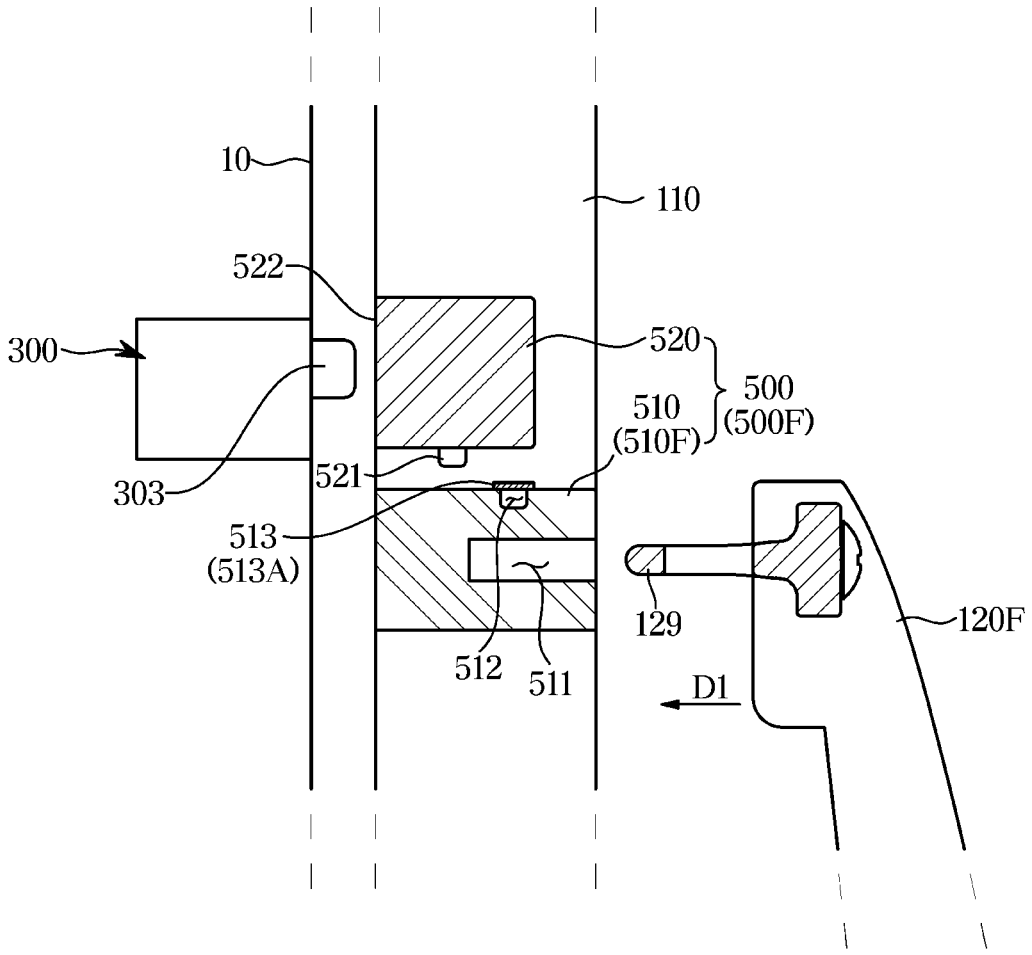
FIG. 13 is a view illustrating a restraining device and a locking guide in a state in which an auxiliary door is open in a washing machine according to an embodiment of the disclosure.
Figure 14:
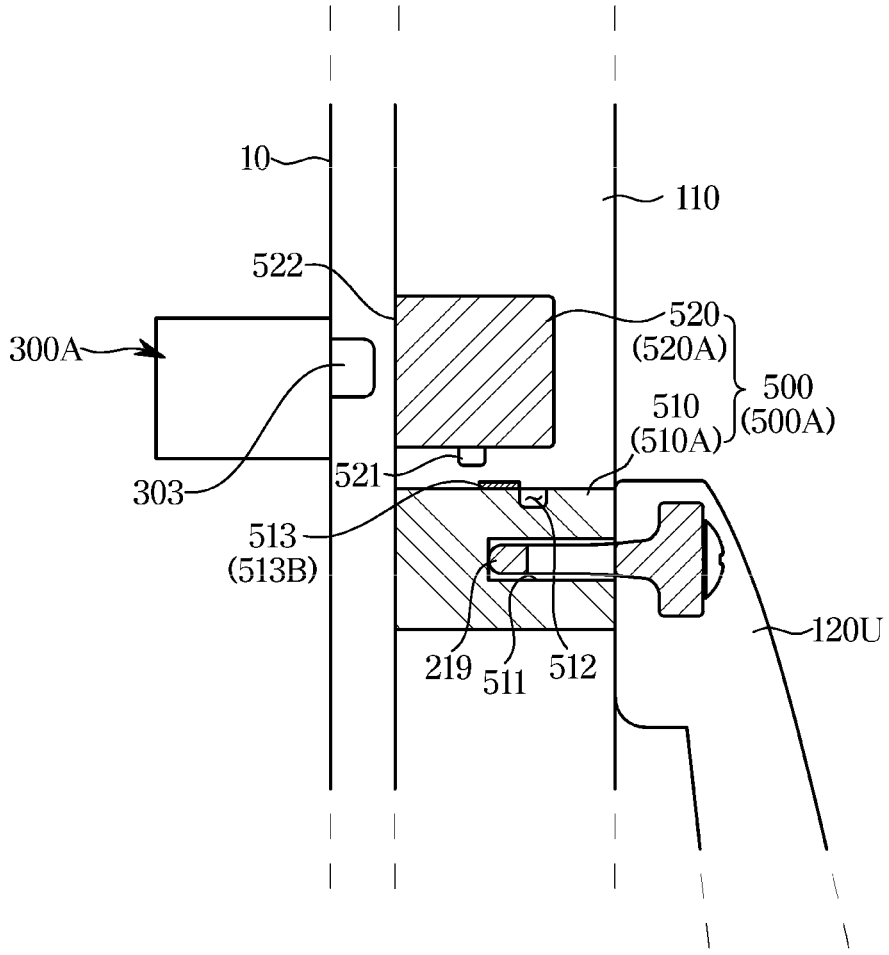
FIG. 14 is a view illustrating a restraining device and a locking guide in a state in which an auxiliary door is closed in a washing machine according to an embodiment of the disclosure.
Figure 15:
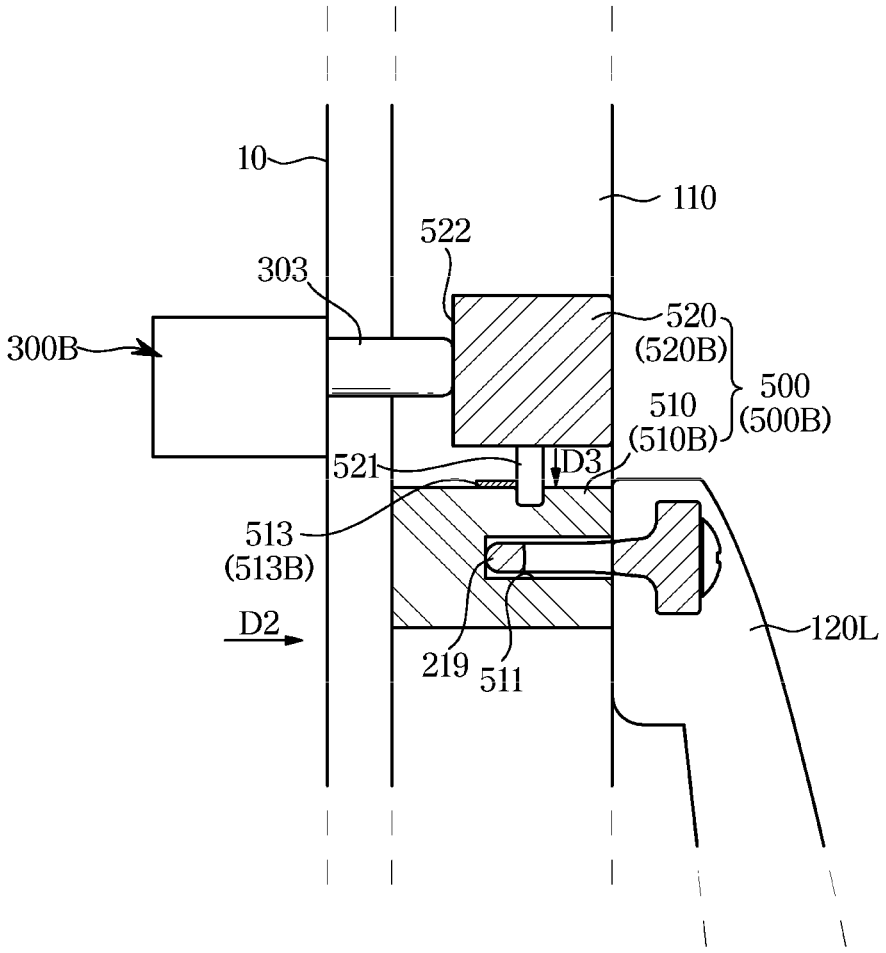
FIG. 15 is a view illustrating a state in which an auxiliary door is locked by a restraining device through a locking guide driven according to an embodiment of the disclosure.

FIG. 13 is a view illustrating a restraining device and a locking guide in a state in which an auxiliary door is open in a washing machine according to the third embodiment of the disclosure, FIG. 14 is a view illustrating a restraining device and a locking guide in a state in which an auxiliary door is closed in a washing machine according to the third embodiment of the disclosure, and FIG. 15 is a view illustrating a state in which an auxiliary door is locked by a restraining device through a locking guide driven according to the third embodiment of the disclosure.

Referring to FIGS. 13 to 15, the restraining device 500 may include a first restraining part 510 into which the insertion portion 129 is inserted and a second restraining part 520 restraining the first restraining part 510 in association with the locking guide 300.

Unlike the restraining device 400 shown in the second embodiment of the disclosure, the first restraining part 510 is not moved in the first direction D1 by the insertion of the insertion portion 129. In addition, the first restraining part 510 may be provided to restrain the insertion portion 129 in association with the insertion of the insertion portion 129 when the insertion portion 129 is inserted.

The first restraining part 510 may include a stopper 513 for restricting entry of a fixing member 521 into an insertion area 512.

The stopper 513 may be provided to move between a first position 513A restricting the movement of the fixing member 521 and a second position 513B not restricting the movement of the fixing member 521.

In detail, the stopper 513 may move between the first position 513A and the second position 513B in association with the insertion of the insertion portion 129.

When the first restraining part 510 is in a first state 510F, the stopper 513 may be arranged at the first position 513A. Accordingly, in the first state 510F in which the first restraining part 510 does not restrain the insertion portion 129, the fixing member 521 may not be fixed to the first restraining part 510, so that the second restraining part 520 may not restrain the first restraining part 510.

When the insertion portion 129 is inserted into the first restraining part 510 in the first direction D1, the stopper 513 may be moved to the second position 513B in association with the insertion of the insertion portion 129.

Accordingly, when the first restraining part 510 is switched to a second state 510A in which the insertion portion 129 is inserted into the first restraining part 510, the fixing member 521 may be set into a state of being insertable into the insertion area 512.

In the second state 510A of the first restraining part 510 in which the insertion portion 129 is inserted into the first restraining part 510, when the push rod 303 of the locking guide 300 is protruded, the protruding push rod 303 presses the second restraining part 520, and the fixing member 521 may be moved in the third direction D3 in association with the movement of the second restraining part 520 in the second direction D2 and thus may be inserted into the insertion area 512.

When the fixing member 521 is inserted into the insertion area 512, the first restraining part 510 is switched to a third state 510B in association with the fixing member 521 in which the restraining of the insertion portion 129 is not released even when an external force is applied to the first restraining part 510.

Accordingly, the second restraining part 520 may restrain the first restraining part 510 and the restraining device 500 may lock the auxiliary door 120. That is, the locking guide 300 may guide locking of the restraining device 500 such that the restraining device 500 locks the auxiliary door 120.

Hereinafter, a restraining device 600 according to the fourth embodiment of the disclosure will be described. Components except for the restraining device 600 described below are the same as those of the washing machine 1 according to the second embodiment of the disclosure, and details of thereof will be omitted.

Figure 16:
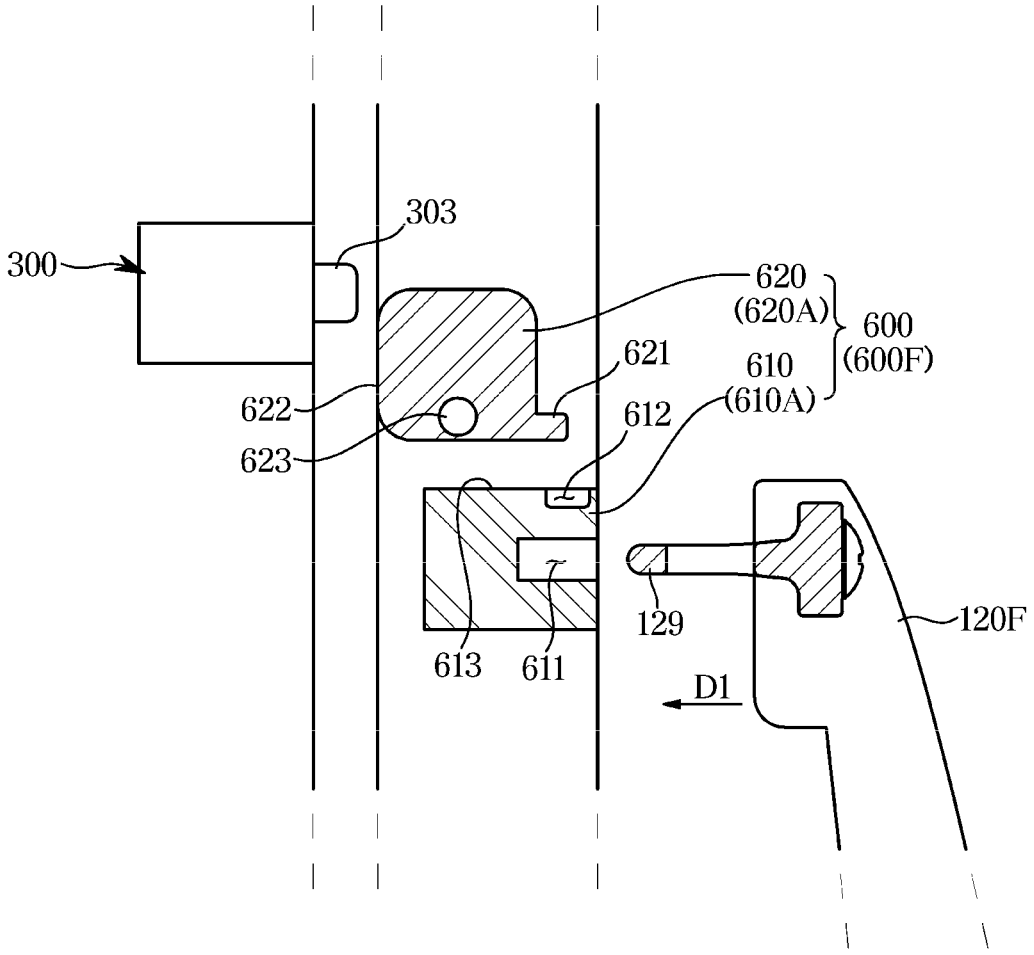
FIG. 16 is a view illustrating a restraining device and a locking guide in a state in which an auxiliary door is open in a washing machine according to an embodiment of the disclosure.
Figure 17:
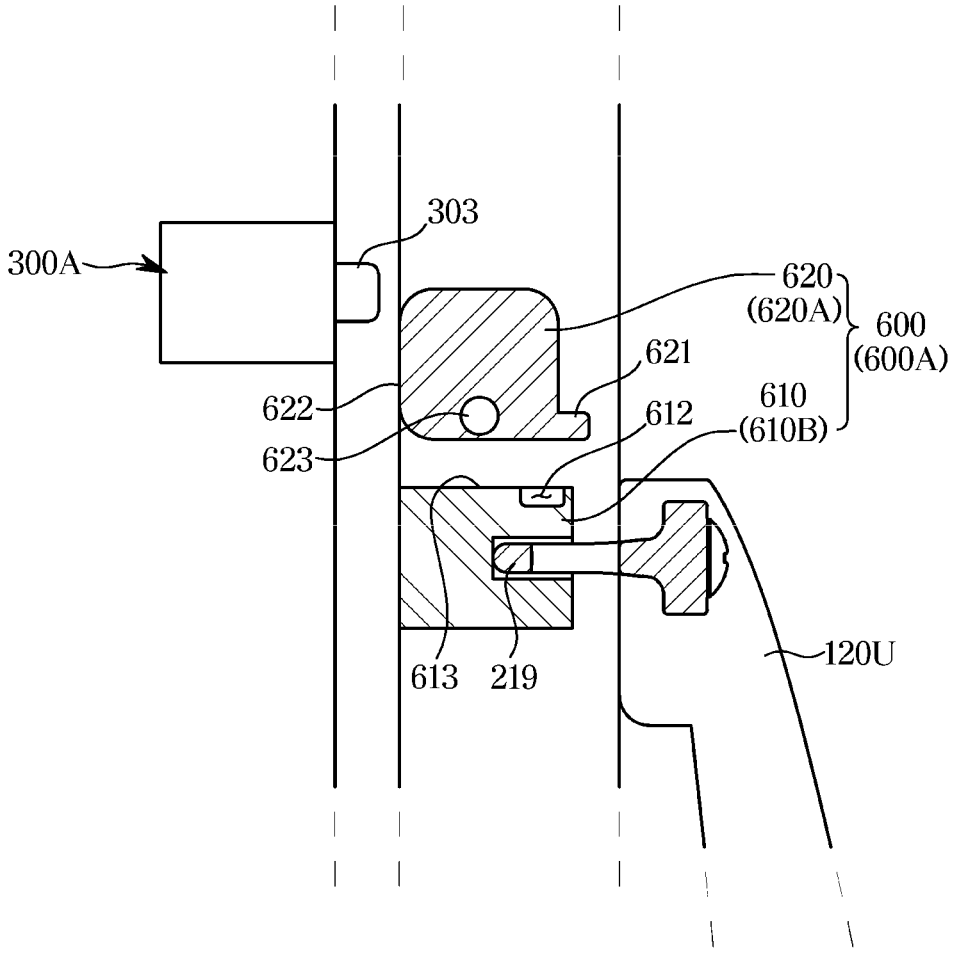
FIG. 17 is a view illustrating a restraining device and a locking guide in a state in which an auxiliary door is closed in a washing machine according to an embodiment of the disclosure.
Figure 18:
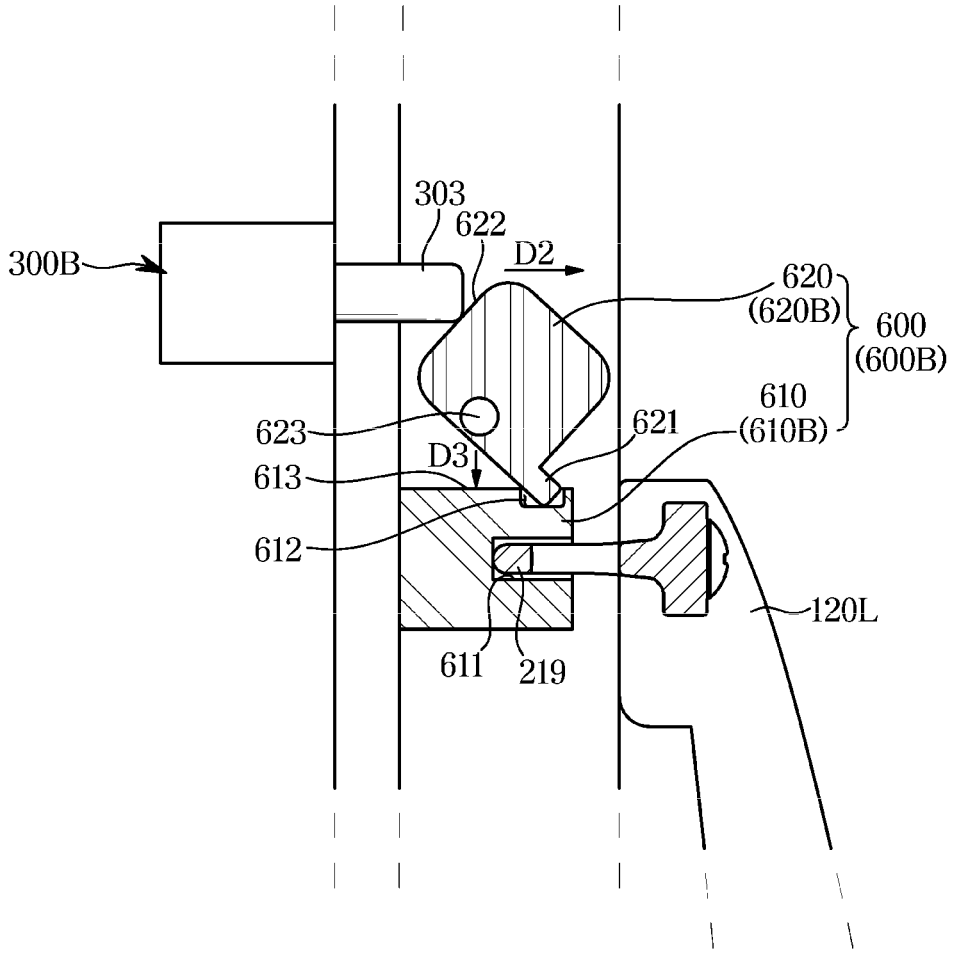
FIG. 18 is a view illustrating a state in which an auxiliary door is locked by a restraining device through a locking guide driven according to an embodiment of the disclosure.

FIG. 16 is a view illustrating a restraining device and a locking guide in a state in which an auxiliary door is open in a washing machine according to the fourth embodiment of the disclosure, FIG. 17 is a view illustrating a restraining device and a locking guide in a state in which an auxiliary door is closed in a washing machine according to the fourth embodiment of the disclosure, and FIG. 18 is a view illustrating a state in which an auxiliary door is locked by a restraining device through a locking guide driven according to the fourth embodiment of the disclosure.

The restraining device 600 may include a first restraining part 610 that is provided to be movable in the first direction D1 that the insertion portion 129 is inserted, and while moving in the first direction D1 in association with the insertion of the insertion portion 129, restrains the insertion portion 129.

The restraining device 600 may include a second restraining part 620 that is provided to be rotatable in the second direction D2 and while rotating in the second direction D2 in association with the locking guide 300, restrains the first restraining part 610.

The second restraining part 620 may include a pressing surface 622 pressed by the locking guide 300 in the second direction D2, a fixing part 621 fixing the first restraining part 610 by the rotation of the second restraining part 620, and a rotation axis 623.

The second restraining part 620 may be rotated in the second direction D2 about the rotation axis 623 when the locking guide 300 presses the pressing surface 622.

In addition, although not shown in the drawings, the restraining device 600 may include an elastic member (not shown) that presses a side opposite to the pressing surface 622, and when the locking guide 300 does not press the second restraining part 620, elastically presses the second restraining part 620 such that the second restraining part 620 rotates in the first direction D1 and returns to the original position.

A fixing part 621 may be moved downward in association with the second restraining part 620 pressed by the locking guide 300 and rotated in the second direction D2. On the contrary, when the pressing of the locking guide 300 is terminated and the second restraining part 620 is rotated in the first direction D1, the fixing part 621 may be moved upward in association therewith.

When the fixing part 621 is moved downward, the fixing part 621 may be inserted into the first restraining part 610, and the fixing part 621 inserted into the first restraining part 610 may prevent the first restraining part 610 from being separated from a fixed position.

Referring to FIG. 16, when the auxiliary door 120 is arranged in the open state 120F, the first restraining part 610 may be arranged at a first position 610A.

In addition, the second restraining part 620 may be arranged at a third position 620A. A state in which the first restraining part 610 is arranged at the first state 610F and the second restraining part 620 is arranged at the third position 620A is defined as a first state 600F of the restraining device 600.

Although not shown in the drawings, the first restraining part 610 and the second restraining part 620 may be maintained at the first position 610A and the third position 620A, respectively, through an elastic member or the like.

The first restraining part 610 may include a block area 613 that restricts the fixing part 621 from being inserted thereinto by rotating toward the first restraining part 610 and an insertion area 612 that allows the fixing part 621 to be inserted thereinto by rotating toward the first restraining part 610 such that the first restraining part 610 is fixed by the second restraining part 620.

When the auxiliary door 120 is arranged in the open state 120F, the fixing part 621 rotated in the second direction D2 by the pressing of the locking guide 300 comes into contact with the block area 613 without being inserted into the insertion area 612.

That is, when the first restraining part 610 and the second restraining part 620 are arranged at the first position 610A and the third position 620A, respectively, the fixing part 621 rotated toward the first restraining part 610 comes into contact with the block area 613 without being inserted into the insertion portion 612 so that the fixing part 621 may not fix the first restraining part 610. Therefore, the second restraining part 620 may not restrain the first restraining part 610.

In this case, even when the locking guide 300 presses the pressing surface 622, the fixing part 621 may not fix the first retraining part 610 due to the block area 613, and the second restraining part 620 even when pressed by the locking guide 300 may not fix the first restraining part 610.

As such, when the restraining device 600 is in the first state 600F, the locking guide 300 may not perform guide on the restraining device 600 such that the restraining device 600 locks the auxiliary door 120.

Thereafter, referring to FIG. 17, the first restraining part 610 may be pressed against the insertion portion 129 and thus arranged at the second position 610B.

The first restraining part 610, moving in the first direction D1, may restrain the insertion portion 129, so that the auxiliary door 120 may be set into a closed state.

However, in this state, since the second restraining part 620 does not restrain the first restraining part 610, the auxiliary door 120 may be restrained onto the restraining device 600 in an unlocking state 120U in which the auxiliary door 120 is not locked onto the restraining device 600 and is openable by an external force.

In a second state 600A of the restraining device 600 described above, the first restraining part 610 may not depart from the second position 610B and the auxiliary door 120 may be held restrained when an external force does not occur.

However, with the first restraining part 610 arranged at the second position 610B, when the second restraining part 620 is rotated by the locking guide 300 and thus arranged at a fourth position 620B, the second restraining part 620 may restrain the first restraining part 610. That is, in the second state 600A of the restraining device 600 described above, when the locking guide 300 is driven, the restraining device 600 may be switched into a state of capable of locking the auxiliary door 120.

The restraining device 600 in the second state 600A restrains the auxiliary door 120 in an unlocked state, but when the locking guide 300 is driven, the first restraining part 610 is restrained by the second restraining part 620 rotated in association with the locking guide 300, so that the restraining device 600 is switched into a state capable of locking the auxiliary door 120.

The locking guide 300 is driven by the controller 320 so that the push rod 303 may be protruded in the second direction D2 as shown in FIG. 18.

When the locking guide 300 presses the second restraining part 620 in the second direction D2, the second restraining part 620 may be rotated about the rotating axis 623 in the second direction D2, and in association with the rotation, the fixing part 621 is rotated in the second direction D2 while moving in the lower side direction D3. The position of the fixing part 621 moved in the third direction D3 due to the rotation of the second restraining part 620 in the second direction D2 may be defined as a fourth position 620B.

As the first restraining part 610 is arranged at the second position 6106 and the second restraining part 620 is arranged at the fourth position 620B, the fixing part 621 moving in the third direction D3 may be inserted into the insertion area 612 and thus restrain the first restraining part 610.

Accordingly, even when an external force is transmitted to the first restraining part 610 in the first direction D1, the fixing part 621 prevents the first restraining part 610 from departing from the second position 610B. Therefore, even when an external force is transmitted to the first restraining part 610 in the first direction D1, the first restraining part 610 may maintain the auxiliary door 120 in a locked state.

When the push rod 303 is kept protruded by the controller 320, the pressing surface 622 of the second restraining part 620 is continuously pressed so that the second restraining part 620 is continuously arranged at the fourth position 620B without departing from the fourth position 620B.

That is, the locking guide 300 may guide the restraining device 600 to lock the auxiliary door 120 by protruding the push rod 303. When the pressing surface 622 is kept pressed by the protruding pushing rod 303, the locking guide 300 may guide the restraining device 600 to maintain a locking state of the restraining device 600 with respect to the auxiliary door 120.

In a third state 600B in which the restraining device 600 locks the auxiliary door 120 as described above, the locking guide 300 may perform locking guide 300B on the restraining device 600.

On the contrary, when the push rod 303 is retracted and the pressing on the pressing surface 622 is terminated, the locking guide 300 may perform unlocking guide 300A on the restraining device 600 to unlock the auxiliary door 120.

Hereinafter, the door sensor 310 sensing the opening or closing of the auxiliary door 120 according to the embodiment of the disclosure will be described in detail.

The door sensor 310 to be described below may be applied to the first to fourth embodiments of the disclosure described above. However, for the sake of convenience in description, the following description will be made in relation on the restraining apparatus 200 according to the embodiment of the disclosure.

As described above, since the door 100 does not include electric components, the opening and closing of the auxiliary door 120 may not be sensed from the inside of the door 100.

To this end, the washing machine 1 according to the embodiment of the disclosure may include the door sensor 310 that is arranged inside the main body 10 to sense the opening and closing of the auxiliary door 120.

In the open state 120F or the unlocking state 120U of the auxiliary door 120, when a washing stroke of the washing machine 1 is started the wash water may leak to the outside through the auxiliary inlet 111, and when a spin-drying cycle of the washing machine 1 is performed, the user may be injured by the drum 30 rotating at a high speed.

Here, the unlocking state 120U is a state in which the auxiliary door 120 is in a closed state but is incapable of being locked. Therefore, the unlocking state 120U may be expressed as a closed state 120U. Hereinafter, the closed state 120U of the auxiliary door 120 is defined as a state in which the auxiliary door 120 is closed onto the door body 110 without being locked by the restraining device 200.

In order to remove the above described limitations, the washing machine 1 may further include the door sensor 310 sensing whether the auxiliary door 120 is in the closed state 120U.

Upon receiving a sensing signal that the auxiliary door 120 is maintained in the closed state from the door sensor 310, the controller 320 controls the locking guide 300 to drive the locking guide 300, and performs washing, spin-drying, and drying strokes of the washing machine 1.

However, when the closed state of the auxiliary door 120 is not sensed by the door sensor 310, a signal indicating that the closed state of the auxiliary door 120 is not sensed is transmitted to the controller 320, and the controller 320 may control the washing machine 1 to preclude the driving of the washing machine 1.

In detail, first, when the door sensor 310 detects that the auxiliary door 120 is in the closed state 120U, the controller 320 may control the locking guide 300 so that the restraining device 200 locks the auxiliary door 120.

Second, when the locking guide 300 presses the restraining device 200 according to the control of the controller 320, the controller 320 may perform washing, spin-drying, and drying strokes of the washing machine 1.

In addition, when the user desires to introduce additional laundry into the drum 30 in the middle of the washing stroke by opening the auxiliary door 120, the user opens the auxiliary door 120, introduces additional laundry, closes the auxiliary door 120, and resumes the washing stroke. In this case, only when the closed state of the auxiliary door 120 is sensed by the door sensor 310, the controller 320 drives the locking guide 300 and resumes the washing stroke, and when the closed state of the auxiliary door 120 is not sensed, the controller 320 may not proceed with the washing stroke of the washing machine 1.

In detail, when the user stops the washing stroke and inputs a signal to the controller 320 through the inputters (81*a* and 81*b* in FIG. 1) to open the auxiliary door 120 for the introduction of laundry, the controller 320 may control the locking device 200 such that the restraining device 200 unlocks the auxiliary door 120.

Thereafter, when the user opens the auxiliary door 120, introduces laundry, closes the auxiliary door 120, and inputs a signal to the controller 320 through the inputters 81*a* and 81*b* to resume the washing process, the controller 320 checks whether the auxiliary door 120 is opened or closed through the door sensor 310 and controls the locking guide 300 such that the restraining device 200 locks the auxiliary door 120, and then resume the washing stroke.

When the user inputs a signal to the inputters 81*a* and 81*b* to open the auxiliary door 120 in the middle of the washing stroke, the controller 320 may determine whether the current state of the washing machine 1 is in a situation that release of the locked state of the auxiliary door 120 is performable.

For example, it is determined whether the washing water is more than half full in the tub 20, the drum 30 is rotating, the temperature inside the drum 30 is high, or the like by a value transmitted through the sensor. Then, when the current state of the washing machine 1 is in a situation that the release of the locked state of the auxiliary door 120 is performable, the controller 320 may drive the locking guide 300 to unlock the auxiliary door 120.

The door sensor 310 may have a reed switch whose terminal is arranged to come into contact with a component of the door 100 to thereby sense whether the auxiliary door 120 is opened or closed using an on/off signal of the reed switch.

In detail, referring to FIGS. 4 to 6, the auxiliary door 120 may include a sensing protrusion 141 protruding toward the door body 110.

The door body 110 may include an intermediate hole 142 allowing the sensing protrusion 141 to be inserted thereinto or pass therethrough when the auxiliary door 120 is locked onto the door body 110. The intermediate hole 142 may be formed in the front-rear direction. The front and rear surfaces of the door body 110 may be provided to communicate with each other.

The sensing protrusion 141 may have a length large enough to protrude to the outside of the rear surface of the door body 110 by passing through the intermediate hole 142 when the auxiliary door 120 and the door body 110 are coupled to each other.

Accordingly, when the auxiliary door 120 is closed onto the door body 110, the sensing protrusion 141 may pass through the intermediate hole 142 and protrude to the outside of the rear surface of the door body 110.

However, the disclosure is not limited thereto, and the door body 110 may include an intermediate member (not shown) arranged in the intermediate hole 142 and pressed in the direction of the main body 10 by the sensing protrusion 141 when the sensing protrusion 141 is inserted into the intermediate hole 142.

The intermediate member (not shown) may be arranged inside the intermediate hole 142 and protrude outward from the rear surface of the door body 110 only when pressed by the sensing protrusion 141.

That is, the intermediate member (not shown) not pressed by the sensing protrusion 141 may be arranged inside the intermediate hole 142 without protruding to the outside of the rear surface of the door body 110.

That is, the sensing protrusion 141 or the intermediate member (not shown) may be provided to come into direct contact with the reed switch of the door sensor 310 by passing through the intermediate hole 142.

As described above, the door sensor 310 may be arranged inside the main body. The door sensor 310 may include a detector 311 arranged in the front and coming into contact with the sensing protrusion 141. The reed switch described above may be arranged on the detector 311.

The detector 311 is formed on the front panel 10*b* of the main body 10 and is configured to sense that the auxiliary door 120 is in a closed state in response to a contact with any component inserted through the sensing hole 142 that is provided to communicate with the detector 311.

When the door body 110 is closed onto the main body 10 in a closed state of the auxiliary door 120, the sensing protrusion 141 protruding backward is inserted into the sensing hole 142 while the door 100 is being closed and thereby comes into contact with the detector 311.

Therefore, when the auxiliary door 120 is closed onto the door body 110, the sensing protrusion 141 is inevitably inserted into the sensing hole 142 and is coupled to the detector 311, so that the door sensor 310 may detect that the auxiliary door 120 is closed.

Figure 19:
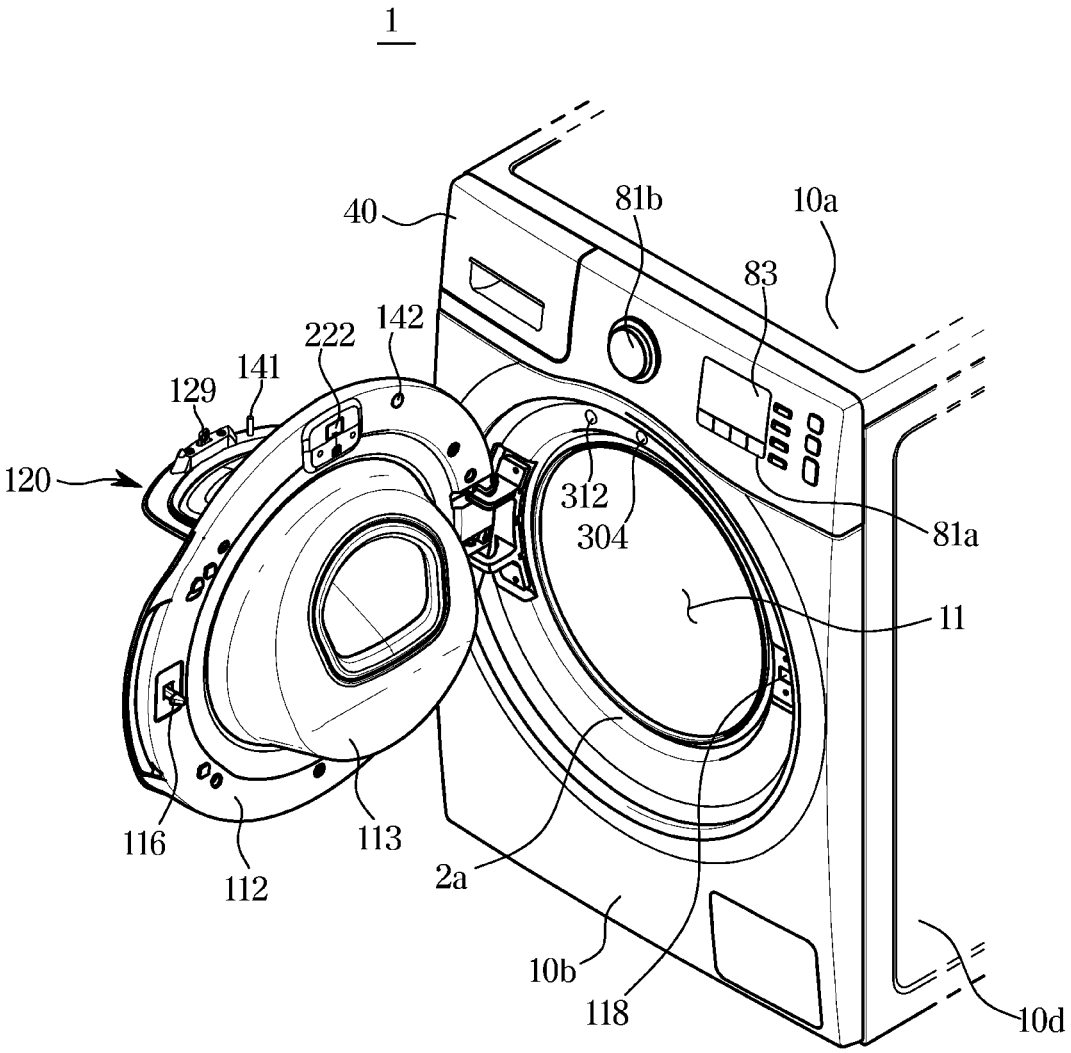
FIG. 19 is a view illustrating a state in which a door is open with an auxiliary door open according to an embodiment of the disclosure.

As illustrated in FIG. 19, when the auxiliary door 120 is in the open state 120F, the sensing protrusion 141 does not protrude outside of the intermediate hole 142.

Therefore, in such a state, the door 100 being closed does not cause any configuration to be inserted into the sensing hole 142 and the detector 311 does not detect any contact configuration and therefore senses that the auxiliary door 120 is not in a closed state.

As such, even when electric components are not arranged inside the door 100, the door sensor 310 arranged inside the main body 10, the sensing protrusion 141 arranged on the auxiliary door 120, and the intermediate hole 142 arranged in the door body 110 may easily transmit information about a closed state of the auxiliary door 120 to the controller 320.

In addition, the controller 320 may control the stroke of the washing machine 1 not only using the information transmitted from the door sensor 310 but also using information detecting whether the driving of the locking guide 300 is properly performed before controlling the stroke of the washing machine 1.

The locking guide 300 may include a detection sensor 305 that is electrically connected to the controller 320 and detects a distance travelled by the push rod 303 in the second direction D2 (see FIG. 6).

The detection sensor 305 may detect a value of the distance protruded by the push rod 303 in the second direction D2 when the locking guide 300 is switched from the unlocking guide state 300A to the locking guide state 300B.

In the first state 200F of the restraining device 200, even when the push rod 303 presses the pressing surface 222, the fixing member 221 is not protruded, and thus the push rod 303 does not move in the second direction D2 or move only a short distance. In the third state 200B of the restraining device 200, when the push rod 303 presses the pressing surface 222, the fixing member 211 is moved, and thus in association with the movement, the push rod 303 may protrude a large length.

In this case, when the distance protruded by the push rod 303 has a value of 1 in the first state 200F of the restraining device 200, and has a value of 10 in the third state 200B of the restraining device 200, the controller 320 may determine that the locking guide 300 has guided the locking of the restraining device 200 when the distance value detected by the detection sensor 305 is 5 or more and control the washing machine 1 to start the washing stroke of the washing machine 1.

That is, when the value detected by the detection sensor 305 is equal to or greater than a predetermined value, the controller 320 may determine that the pressing surface 222 is pressed by the push rod 303, the first restraining part 210 is restrained by the second restraining part 220, and thus the auxiliary door 120 is locked by the restraining device 200.

Accordingly, the controller 320 may receive a certain value from the detection sensor 305 before proceeding with the stroke of the washing machine 1, and may proceed with the stroke of the washing machine 1 only when the received value is greater than or equal to the predetermined value.

First, the controller 320 may receive information about whether the auxiliary door 120 is opened or closed through the door sensor 310 and drive the locking guide 300. Then, the controller 320 may receive information about whether the locking guide 300 properly operates from the detection sensor 305 and proceed with the washing stroke of the washing machine 1.

That is, since the controller 320 proceed with the washing stroke of the washing machine 1 after receiving the two signals through the door sensor 310 and the detection sensor 305, the washing stroke of the washing machine 1 may be performed in a safe manner.

However, the disclosure is not limited thereto, and one of the door sensor 310 and the detection sensor 305 may be omitted.

In the description above, and the configuration of the washing machine according to the disclosure and the operation thereof have been described in detail. Hereinafter, the control performed based on the configuration of the washing machine described above will be described in detail with reference to FIG. 20*a* and FIG. 20*b*.

Figure 20A:
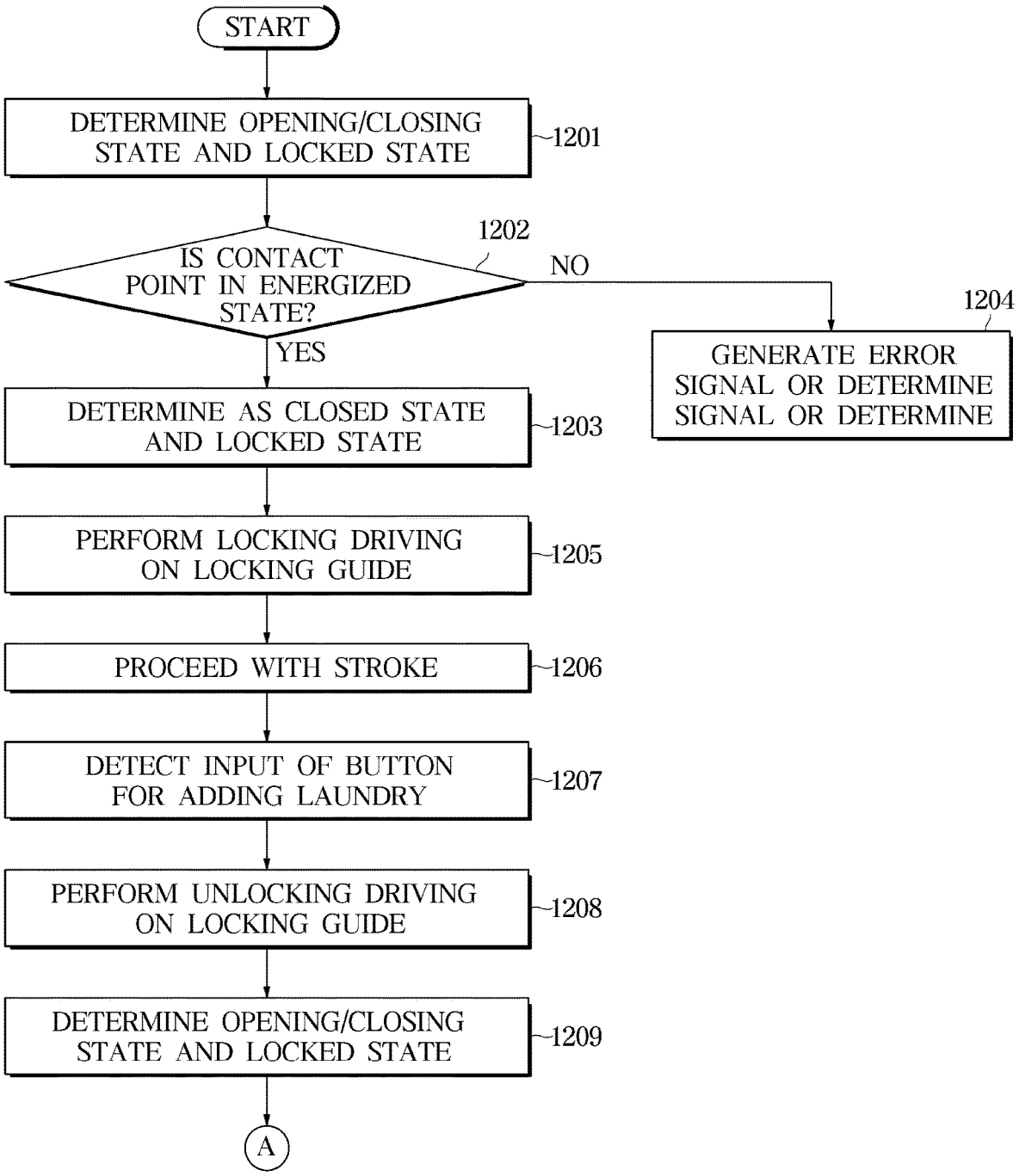
FIG. 20*a* is a flowchart showing a method of controlling the washing machine according to an embodiment of the disclosure.
Figure 20B:
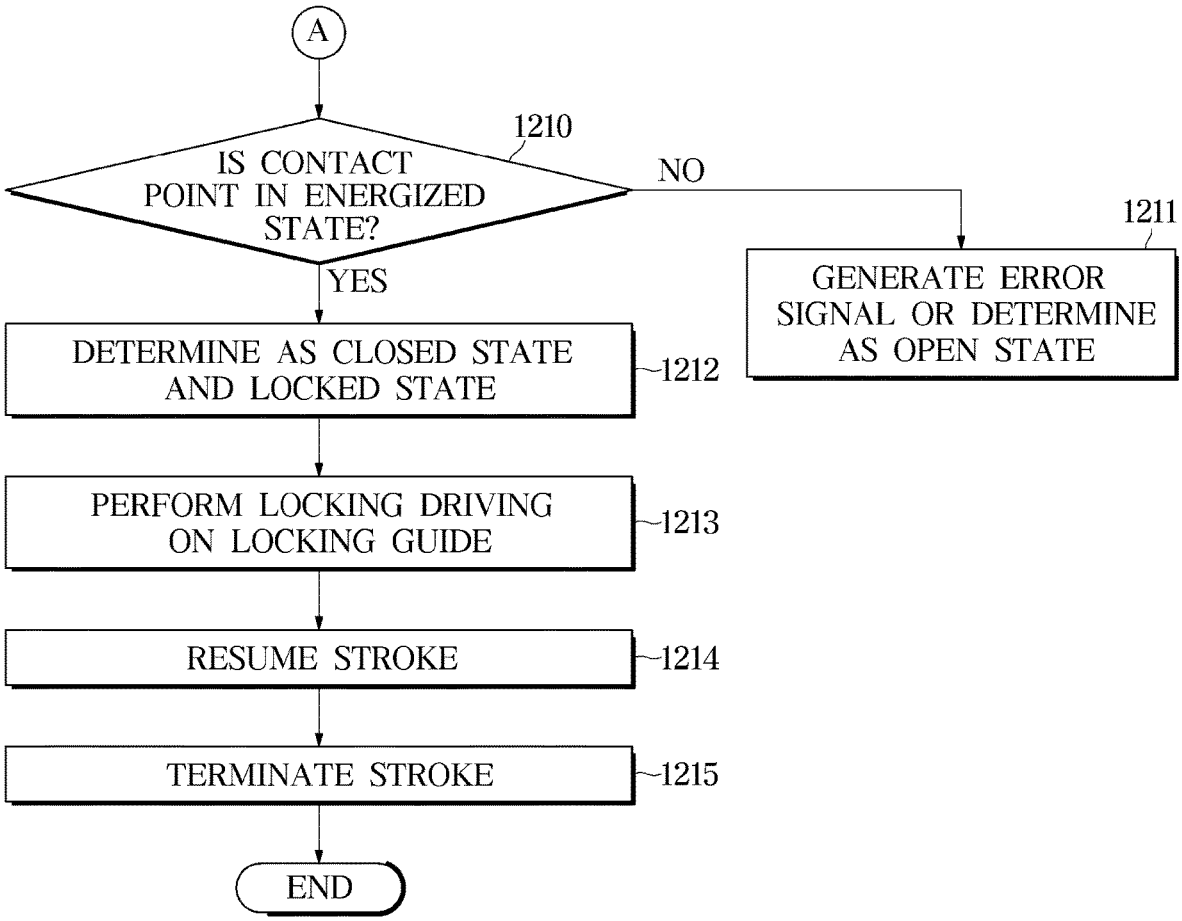
FIG. 20*b* is a flowchart showing a method of controlling the washing machine according to an embodiment of the disclosure.

FIG. 20*a* and FIG. 20*b* is a flowchart showing a method of controlling the washing machine according to the first to fourth embodiments of the disclosure. However, this is only an exemplary embodiment for achieving the object of the disclosure, and some operations may be added or omitted as needed. It should be understood that the method of controlling the washing machine according to the embodiment of the disclosure may be performed directly or indirectly by the controller 320.

Here, the controller 320 is provided to control various electric components constituting the washing machine 1, and may include a processor that may be configured as an integrated circuit for providing a control signal to the various electric components, in which the processor may include an arithmetic logic operator, a register, a program counter, an instruction decoder, a control circuit, and the like.

According to the embodiment, the controller 320 may control the stroke of the washing machine 1 and the operation of the auxiliary door according to a sensing result of the door sensor 310 provided in the main body 10. The stroke of the washing machine 1 may include at least one of a washing stroke, a rinsing stroke, and a spin-drying stroke.

The controller 320 may determine whether the auxiliary door 120 is opened or closed through the door sensor 310 (1201). In addition, as described above, the controller 320 may determine whether the door is opened or closed based on the position of the sensing protrusion 141 passing through the through hole using the door sensor 310. The determination may be achieved based on the sensing result of the door sensor 310. For example, the sensing result may be a result of whether a contact has occurred between the sensing protrusion 141 and the door sensor 310.

On the other hand, the door sensor 310 is provided with a switch that includes at least one contact point to pass or block an electrical signal. For example, the switch may be a reed switch or a micro switch, but the switch according to the disclosure is not limited thereto as long as it can pass or block an electrical signal, such a pulse wave. The contact point of the switch may be in an open state when the auxiliary door is open, or may be in a shorted state when the auxiliary door is closed, that is, in an energized state. As a result, the controller 320 may determine whether the auxiliary door is opened or closed based on the state of the contact point.

The controller 320 detects whether the contact point is in the energized state (1202), and when the contact point is in the energized state, determines that the auxiliary door 120 is in the closed state (1203). On the contrary, when the contact point is not in the energized state, the controller 320 may generate an error signal or as a result of determining an open state, may control the washing machine 1 not to proceed with the stroke (1204).

When the controller 320 determines that the auxiliary door is in the closed state, the controller 200 may control the locking guide 300 to lock the auxiliary door 120 (1205).

Accordingly, the push rod 303 of the locking guide 300 is protruded and the locking guide driving of the locking guide 300 is performed. In this case, the controller 320 may receive an additional signal through the detection sensor 305 and determine whether the auxiliary door 120 is in a locked state.

When the auxiliary door 120 is set into a locked state as the push rod 303 of the locking guide 300 is protruded and the locking guide driving of the locking guide 300 is performed, the controller 320 may control the washing machine 1 to proceed with the stroke (1206).

As described above, according to the structure of the washing machine 1 with the disclosure, when the auxiliary door 120 is in a locked state, the door 100 is considered to be in in a closed state, which is considered a state suitable for performing a series of strokes.

The controller 320, in response to detecting an input of a button for adding laundry by a user during the stroke of the washing machine (1207), controls the locking guide 300 such that the restraining device 200 unlocks the auxiliary door 120 (1208).

That is, the controller 320 controls the locking guide 300 to be subjected to the unlocking guide driving by controlling the locking guide 300 to retract the push rod 303.

Thereafter, the user may press the auxiliary door 120 to open the auxiliary door 120 and add laundry through the opened auxiliary inlet 111. When the user completing addition of the laundry closes the auxiliary door, the controller 320 determines again whether the auxiliary door is opened or closed (1209).

Herein, the controller 320 detects whether the contact point of the switch is in an energized state to determine whether the auxiliary door is opened or closed (1210). Details thereof are described with reference to operation 1201. In addition, the controller 320 performs a control corresponding to a case when the contact point is not in an energized state (1211). The control is described with reference to operation 1204.

Thereafter, when the contact point is in an energized state, the controller 320 determines that the auxiliary door is in a closed state (1212).

When it is determined that the auxiliary door is in a closed state, the controller 320 may control the locking guide 300 to guide the locking of the restraining device 200 again (1213). Details thereof are described with reference to operation 1205.

The controller 320 drives the locking guide 300 to perform the locking guide driving and then controls the washing machine 1 to resume the stroke of the washing machine 1 (1214).

Thereafter, the controller 320 determines whether the stroke of the washing machine is terminated (1215). The controller 320, in order to determine whether it is safe to open the door 100 before opening the door 100, may determine whether the opening of the door 100 is allowable based on the rotation of the drive motor 7 and the internal temperature of the washing machine 1.

The determination may apply to a case of pausing the stroke of the washing machine 1 during the stroke to additionally input laundry. That is, after operation 1207 of detecting an input of a button for adding laundry, the controller 320 may determine whether it is safe to open the auxiliary door 120 before controlling the unlocking guide driving of the locking guide 300.

Hereinafter, a restraining device 700 and a unlock device 800 according to the fifth embodiment of the disclosure will be described. Components except for the restraining device 700 and the unlock device 800 described below are the same as those of the washing machine 1 according to the previous embodiment of the disclosure, and thus details of thereof will be omitted.

Figure 21:
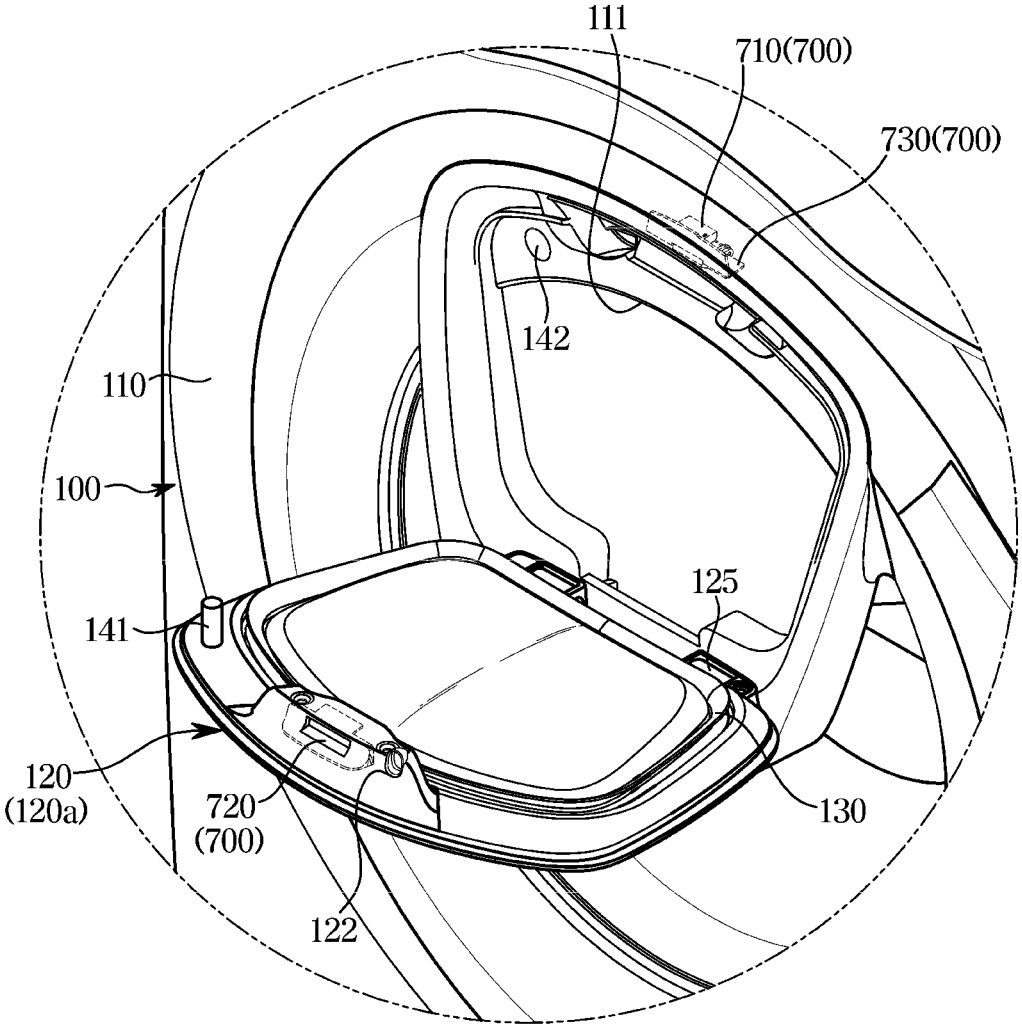
FIG. 21 is an enlarged view illustrating an auxiliary door of a washing machine according to an embodiment of the disclosure.
Figure 22:
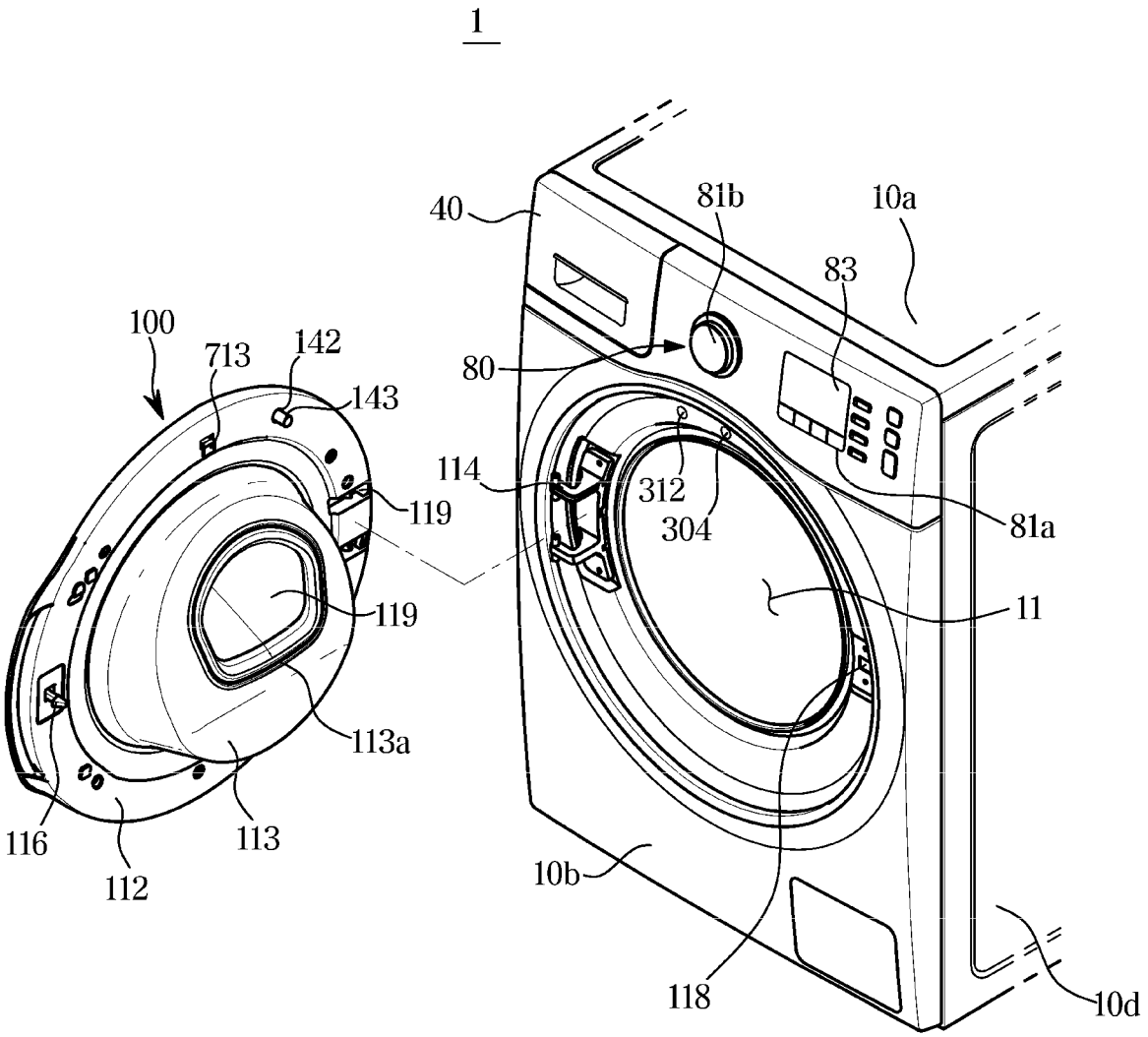
FIG. 22 is a view a state in which a door of a washing machine is dissembled from a main body according to an embodiment of the disclosure.
Figure 23:
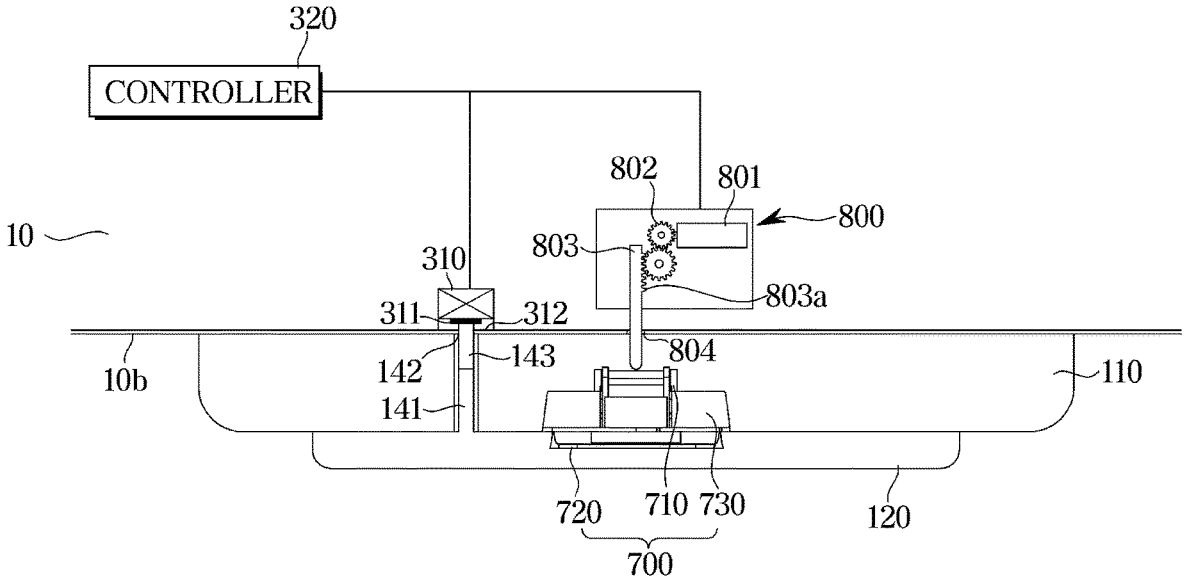
FIG. 23 is a view schematically illustrating the configuration of a door and a controller according to an embodiment of the disclosure.

FIG. 21 is an enlarged view illustrating an auxiliary door of a washing machine according to the fifth embodiment of the disclosure, FIG. 22 is a view a state in which a door of a washing machine is dissembled from a main body according to the fifth embodiment of the disclosure, and FIG. 23 is a view schematically illustrating the configuration of a door and a controller according to the fifth embodiment of the disclosure.

Referring to FIGS. 21 to 23, the door 100 may include the restraining device 700 provided to restrain the auxiliary door 120 on the door 100. However, unlike the restraining devices according to the first to fourth embodiments of the disclosure described above, the restraining device 700 according to the fifth embodiment of the disclosure is provided to have the auxiliary door 120 restrained and locked thereon. Accordingly, the restraining device according to the fifth embodiment of the disclosure will be referred to as a locking device 700.

The locking device 700 serves to maintain the auxiliary door 120 in a closed state, or lock the auxiliary door 120 such that the auxiliary door 120 is not opened by an external force. In this case, as will be described below, when the auxiliary door 120 is set into the closed state, the locking device 700 automatically locks the auxiliary door 120 in conjunction with the closing of the auxiliary door 120.

The washing machine 1 includes the unlock device 800 for applying a physical force to the locking device 700 to release a state of the auxiliary door 120 locked by the locking device 700.

The unlock device 800 may be provided to be electrically connected to the controller 320 and arranged inside the main body 10.

The locking device 700 for locking the auxiliary door 120 is provided to lock the auxiliary door 120 by being pressed by the auxiliary door 120 and is provided to unlock the auxiliary door 120 by a physical force generated by the unlock device 800 arranged on the main body 10 that is an outside of the door 100.

That is, the locking device 700 is provided to lock or unlock the auxiliary door 120 by a physical external force generated outside of the locking device 700 without an electrical connection with the main body 10, so that the conventional wire harness may be omitted from the inside the door body 110.

Hereinafter, the locking device 800, the unlock device 800 for unlocking the locking device 700, and the door sensor 310 for sensing the opening and closing of the locking device 700 will be described in detail.

Figure 24:
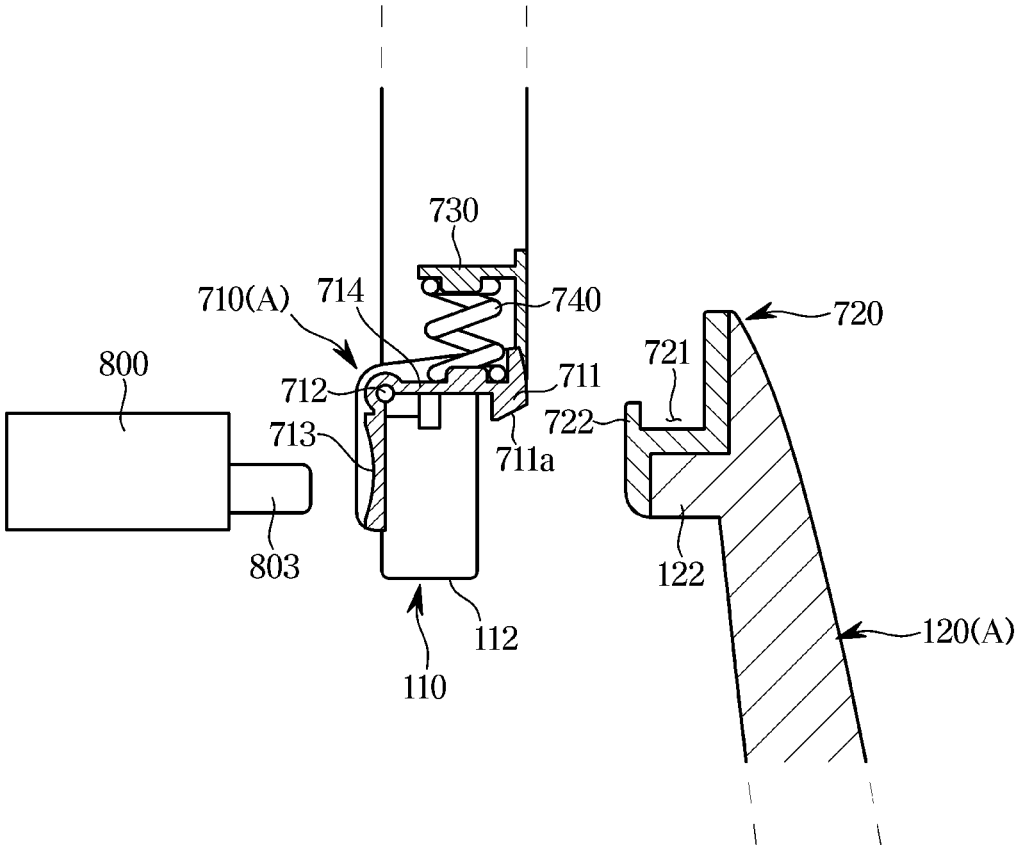
FIG. 24 is a view illustrating an auxiliary door locking device when an auxiliary door is open according to an embodiment of the disclosure.
Figure 25:
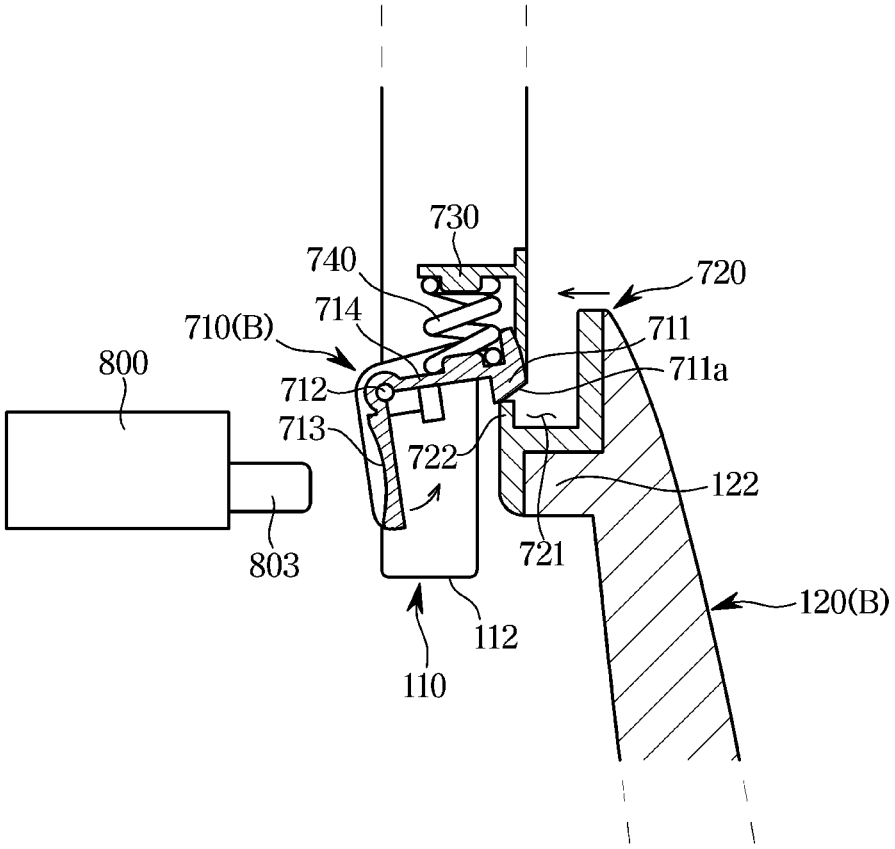
FIG. 25 is a view illustrating an auxiliary door locking device while an auxiliary door is being closed according to an embodiment of the disclosure.
Figure 26:
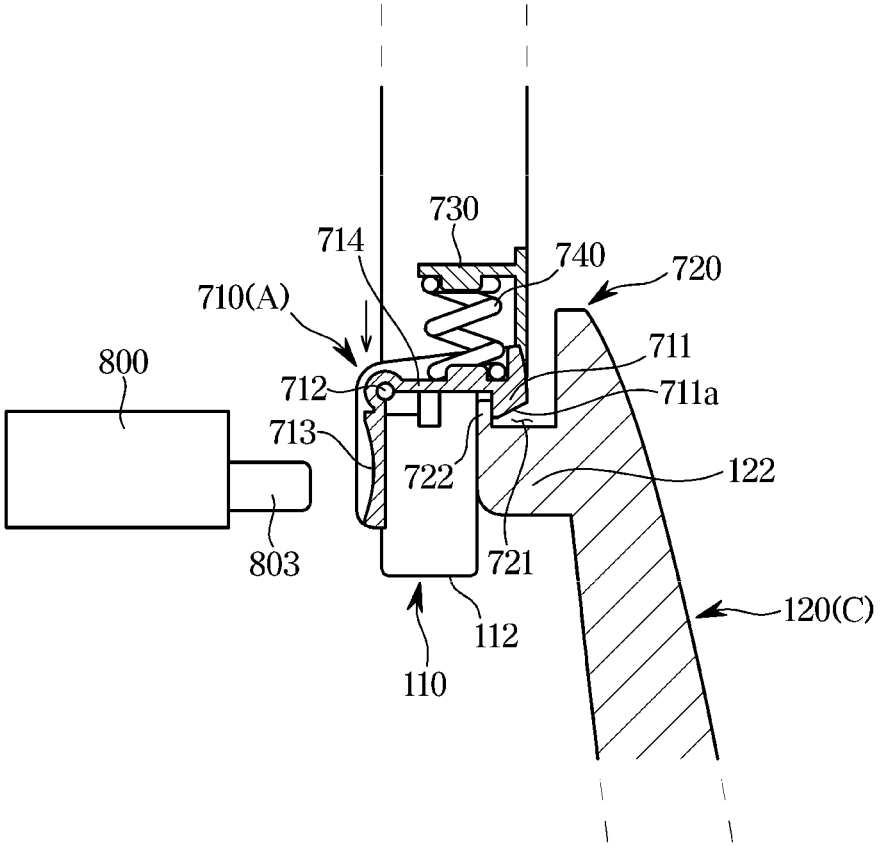
FIG. 26 is a view illustrating an auxiliary door locking device when an auxiliary door is closed according to an embodiment of the disclosure.
Figure 27:
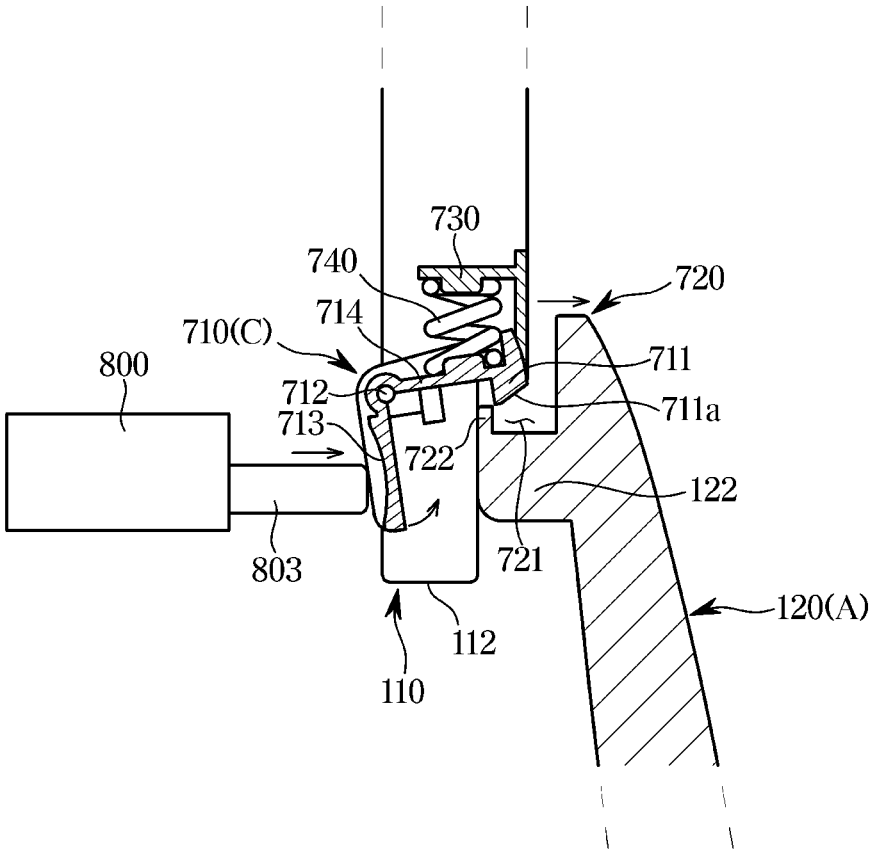
FIG. 27 is a view showing an auxiliary door locking device while an auxiliary door is being opened by an unlock device according to an embodiment of the disclosure.

FIG. 23 is a view schematically illustrating the configuration of a door and a controller according to the fifth embodiment of the disclosure, FIG. 24 is a view illustrating an auxiliary door locking device when an auxiliary door is open according to the fifth embodiment of the disclosure, FIG. 25 is a view illustrating an auxiliary door locking device while an auxiliary door is being closed according to the fifth embodiment of the disclosure, FIG. 26 is a view illustrating an auxiliary door locking device when an auxiliary door is closed according to the fifth embodiment of the disclosure, and FIG. 27 is a view showing an auxiliary door locking device while an auxiliary door is being opened by an unlock device according to the fifth embodiment of the disclosure.

Referring to FIG. 23, the washing machine 1 may include the controller 320, the unlock device 800 electrically connected to the controller 320 and provided to unlock the locking device 700, and the door sensor 310 provided to sense whether the auxiliary door 120 is opened or closed.

The unlock device 800, which is provided to press the locking device 700 to unlock the auxiliary door 120 as will be described below, may be referred to as a pressing device 800.

As described above, the door 100 is provided not to include electric components therein. Accordingly, the unlock device 800 for controlling the unlocking of the locking device 700 and the door sensor 300 for sensing the opening and closing of the auxiliary door 120 may be arranged in the main body 10 rather than in the door body 110.

That is, the unlock device 800 and the door sensor 310, which need to be electrically connected to the controller 320 provided in the main body 10, are arranged in the main body 10, and only the locking device 700 provided to lock the auxiliary door 120 without an electrical signal is arranged on the door body 110 unlike the conventional technology, so that a wire transmitting an electrical signal is arranged only in the main body 10 without being extended into the door body 110.

The locking device 700 may include: a locking member 710 arranged on the door body 110 and configured to lock the auxiliary door 120 by rotation; and a locking portion 720 arranged on the auxiliary door 120 and into which the locking member 710 is inserted through rotation of the locking member 710 such that the auxiliary door 120 is maintained in a closed state.

The locking member 710 may be arranged in the door body 110 and the locking portion 720 may be arranged in the auxiliary door 120. Accordingly, the door body 110 may be referred to as including the locking member 710 and the auxiliary door 120 may be referred to as including the locking portion 720 (see FIG. 21).

That is, the locking member 710, the locking portion 720, and other configurations linked to lock the auxiliary door 120 onto the door body 110 may be referred to as the locking device 700 as a whole, and the inclusion relation may be considered flexible.

The locking member 710 may include a hook part 711 inserted into and hooked with the locking portion 720, a rotation shaft 712 forming a center of rotation of the locking member 710, and a push part 713 pressed by the unlock device 800.

The hook part 711 may be provided in front of the rotation shaft 712. An extension part 714 may be provided between the hook part 711 and the rotation shaft 712. The extension part 714 may extend forward from the rotation shaft 712 so as to be connected to the hook part 711.

The hook part 711 may include an inclined surface 711*a* arranged at a lower side of the extension part 714 and sloping with respect to the vertical direction.

The push part 713 may be arranged at a side opposite to the hook part 711 with respect to the rotation shaft 712. The push part 713 may be provided to extend downward from the rotation shaft 712.

The locking device 700 may include a support frame 730 into which the rotation shaft 712 is inserted to rotatably support the locking member 710.

As the rotation shaft 712 of the locking member 710 is rotatably coupled to the support frame 730, the locking member 710 may be rotated in one direction by an external force transmitted from the inclined surface 711*a* or the push part 713.

The locking member 710 and the support frame 730 may be arranged above the door frame 112 of the door body 110.

The hook part 711 of the locking member 710 may be provided to be exposed to the outside when the auxiliary door 120 is closed, so that the hook part 711 may be inserted into the locking portion 720.

The hook part 711 may be provided to be exposed to the outside in the front or rear direction of the door body 110, so that the hook part 711 inserted into the locking portion 710 may cause the auxiliary door 120 to be restrained onto the door body 110.

The push part 713 of the locking member 710 may be arranged at the rear end of the door frame 112.

In detail, the door frame 112 is provided on the rear surface thereof with a cut-out region that allows the push part 713 to be exposed to the outside, and the push part 713 is arranged in the cut-out region on the rear surface of the door frame 112.

Accordingly, the push part 713 may be provided to be exposed to the outside, so that the unlock device 800 arranged in the main body 10 may press the push part 713 from the outside of the door 100.

When the door 100 is closed, the push part 713 may be arranged at a substantially same height as that of the unlock device 800 while substantially in line with the unlock device 80 in the front-rear direction. Therefore, the unlock device 800 may press the push part 713 against the main body 10 when the door body 110 is in a closed state.

The locking portion 720 may be arranged at the rear end of the upper part 122 of the auxiliary door frame 121 of the auxiliary door 120. When the auxiliary door 120 is coupled to the door body 110, at least a part of the locking portion 720 may overlap the door body 110.

The locking portion 720 may include an insertion groove 721 into which the hook part 711 is inserted and a pressing area 722 that presses the hook part 711 when the auxiliary door 120 is closed while being rotated in the direction of the door body 110.

The pressing area 722 may be arranged behind the insertion groove 721. The pressing area 722 may be protruded upward relative to the insertion groove 721.

The auxiliary door 120 in an open state rotates about the auxiliary door hinge part 125 such that the upper part 122 of the auxiliary door frame 121 is located adjacent to the door body 110, and then is coupled to the door body 110, thereby setting the auxiliary door 120 into a closed state.

When the upper part 122 of the auxiliary door frame 121 is arranged adjacent to the door body 110, the pressing area 722 presses the inclined surface 711*a* of the hook part 711 to move the hook portion 711 upward.

The inclined surface 711*a* in contact with the pressing area 722 may ascend along the pressing area 722. Details thereof will be described below in detail.

The unlock device 800 may be arranged inside the main body 10. The unlock device 800 may be electrically connected to the controller 320 to press the push part 713 under the control of the controller 320.

The unlock device 800 may include a push rod 803 that is provided to be movable in the front-rear direction and a rod driver 801 that drives the push rod 803. The rod driver 801 may generate a rotational force through a configuration such as a motor, and may generate a rotational force in one direction or the other direction by receiving a signal from the controller 320.

The unlock device 800 may include a gear part 802 arranged between the push rod 803 and the rod driver 801 and transmitting the rotational force generated by the rod driver 801 to the push rod 803.

The push rod 803 may include a pinion gear 803*a* that is engaged with the gear part 802 and converts the rotational force into a translational motion. Accordingly, when the rod driver 801 is rotated in one direction, the push rod 803 may be moved forward, and when the rod driver 801 is rotated in the opposite direction, the push rod 803 may be moved backward.

Therefore, the rod driver 801 may press the push part 813 by selectively protruding the push rod 803 based on a signal received from the controller 320.

The unlock device 800, which is arranged inside the main body 10 as described above, may be protruded from the inside of the main body 10 toward the push part 713 by passing through the rod through hole 304 formed in the front panel 10*b*.

When a signal for unlocking the auxiliary door 120 is transmitted from the user to the controller 320, the controller 320 may control the unlock device 800 to protrude the push rod 803 toward the push part 713.

The push rod 803 presses the push part 713, and the locking member 710 may be rotated about the rotation shaft 712 in association with the pressing of the push part 713, causing the hook part 71 to be separated from the insertion groove 721 through rotation.

Therefore, the locking state of the locking device 700 is released by the unlock device 800, and the auxiliary door 120 is unlocked so that the auxiliary door 120 is opened.

Hereinafter, the locking state and the unlocking state of the auxiliary door 120 will be described in detail.

As illustrated in FIG. 24, when the auxiliary door 120 is arranged in an open state A, the locking portion 720 and the locking member 710 may be spaced apart from each other in the front-rear direction.

The locking member 710 may be arranged at the first position A by an elastic member 740 arranged between the extension part 714 and the support frame 730. The elastic member 740 may be arranged between an upper end side of the support frame 730 and an upper surface of the support frame 730 such that the locking member 710 is biased downward.

The user may press the auxiliary door 120 in the direction of the door body 110 to close the auxiliary door 120. As described above, when the auxiliary door 120 is pressed toward the door body 110, the auxiliary door 120 may rotate about the auxiliary door hinge part 125 to approach the door body 110.

Thereafter, as shown in FIG. 25, when the auxiliary door 120 approaching the door body 110 is arranged at a position B before reaching a closed state, the pressing area 722 may press the inclined surface 711*a* in the rearward direction.

When the pressing force of the pressing area 722 is greater than the elastic force of the elastic member 740, the locking member 710 may be rotated in one direction about the rotation shaft 712.

In detail, the inclined surface 711*a* while in contact with the pressing area 722 ascends along the upper end of the pressing area 722 so that the locking member 710 may be rotated in one direction.

Accordingly, the locking member 710 may rotationally move from the first position A to the intermediate position B where the inclined surface 711*a* is in contact with the upper end of the pressing area 722.

As the user continuously presses the auxiliary door 120, the auxiliary door 120 may be further moved backward and may be set into a closed state C, in which case the auxiliary door 120 is coupled to the door body 110. Accordingly, as shown in FIG. 26, the pressing are 722 may be further moved backward and the hook part 711 may be moved downward again to be inserted into the insertion groove 721.

As described above, since the pressing area 722 is protruded upward relative to the insertion groove 721, when the contact between the inclined surface 711*a* and the pressing area 722 is terminated, the hook part 711 having been moved upward by the pressing area 722 may move downward again by the biased elasticity of the elastic member 740.

That is, the locking member 710 may be rotated from the first position A to the intermediate position B by the pressing of the auxiliary door 120 and then may return to the first position A again. The locking member 710 may be arranged at the first position A in the open state A of the auxiliary door 120, and may also be arranged at the first position A even in the closed state C of the auxiliary door 120.

The hook part 711 may be inserted into the insertion groove 721 by being moved downward, and the hook part 711 and the insertion groove 721 may be hooked with each other. Accordingly, the auxiliary door 120 may be set into a locked state C in which the auxiliary door 120 is maintained in a closed state C.

That is, at the same time as being set into the closed state C, the auxiliary door may be set into the locked state C through the automatic hook coupling of the hook part 711 and the insertion groove 721.

In the conventional technology, after the closed state of the auxiliary door is sensed by a sensor arranged inside the door body, the controller controls the locking device to lock the auxiliary door.

Although the locking device 700 according to the embodiment of the disclosure does not include electric components for receiving electrical signals as described above, the auxiliary door 120 is set into a closed state C at the same time as being set into a locked state C, so that auxiliary door 120 may be stably kept coupled to the door body 110 without having electric components inside the door body 110.

Thereafter, when the user manipulates the inputters (81*a* and 81*b* in FIG. 1) to open the auxiliary door 120, an unlocking signal of the auxiliary door 120 may be transmitted to the controller 320.

The controller 320 may control the unlock device 800 to move the push rod 303 forward.

Referring to FIG. 27, the push rod 803 being protruded forward may press the push part 713 arranged in front of the unlock device 800.

Accordingly, the locking member 710 may be rotated in one direction about the rotation shaft 712 by the pressing of the push part 713.

As the locking member 710 rotates, the hook part 711 may move upward and be separated from the insertion groove 721.

As the hook part 711 is separated from the insertion groove 721, the hook coupling between the hook part 711 and the insertion groove 721 is released, and the auxiliary door 120 may be set into an unlocked state A.

The locking member 710, as a result of the hook part 711 separated from the insertion groove 721 by the pressing of the push part 713, may be rotated to the second position C in which the auxiliary door 120 is set into an unlocked state A.

That is, the locking member 710 may be rotationally moved between the first position A in which the auxiliary door 120 is in a locked state and the second position B in which the auxiliary door 120 is in an unlocked state.

As described above, the elastic gasket 130 is arranged on the rear surface of the auxiliary door 120. When the auxiliary door 120 is maintained in a closed state, the elastic gasket 130 is biased in the direction in which the auxiliary door 120 is opened. That is, when the auxiliary door 120 is set into an unlocked state, the auxiliary door 120 may be automatically opened by the elastic restoring force of the elastic gasket 130, and thus set into an open state A.

That is, at the same time as being set into an unlocked state A, the auxiliary door 120 is opened, so that the auxiliary door 120 may be automatically set into an unlocked state A.

As such, the state of the auxiliary door 120 is automatically switched from the unlocked state A to the open state A, so that the auxiliary door 120 may be easily opened through the unlock device 800 arranged in the main body 10 even through electric components are not included in the door 100.

The door body 110 may include an intermediate hole 142 allowing the sensing protrusion 141 to be inserted thereinto or pass therethrough when the auxiliary door 120 is locked onto the door body 110 and an intermediate member 143 arranged in the intermediate hole 142 and pressed by the sensing protrusion 141 toward the main body 10 when the sensing protrusion 141 is inserted into the intermediate hole 142.

The intermediate hole 142 may be formed in the front-rear direction. The front and rear surfaces of the door body 110 may be provided to communicate with each other.

The intermediate member 143 may be arranged inside the intermediate hole 142 and may be protruded outward from the rear surface of the door body 110 only when the sensing protrusion 141 is pressed as shown in FIG. 5.

That is, the intermediate member 143, unless pressed by the sensing protrusion 141, may be provided to be arranged inside the intermediate hole 142 without protruding to the outside of the rear surface of the door body 110.

To this end, an elastic member (not shown) may be provided between the intermediate member 143 and the intermediate hole 142 such that the intermediate member 143 is biased forward.

Although not shown in the drawings, the door body 110 may not include the intermediate member 143 arranged inside the intermediate hole 142 described above. In this case, the sensing protrusion 141 is provided to have a length large enough to be protruded to the outside of the rear surface of the door body 110 by passing through the intermediate hole 142 when the auxiliary door 120 and the door body 110 are coupled to each other.

Hereinafter, the control performed based on the configuration of the washing machine 1 according to the fifth embodiment of the disclosure will be described in detail.

Figure 28A:
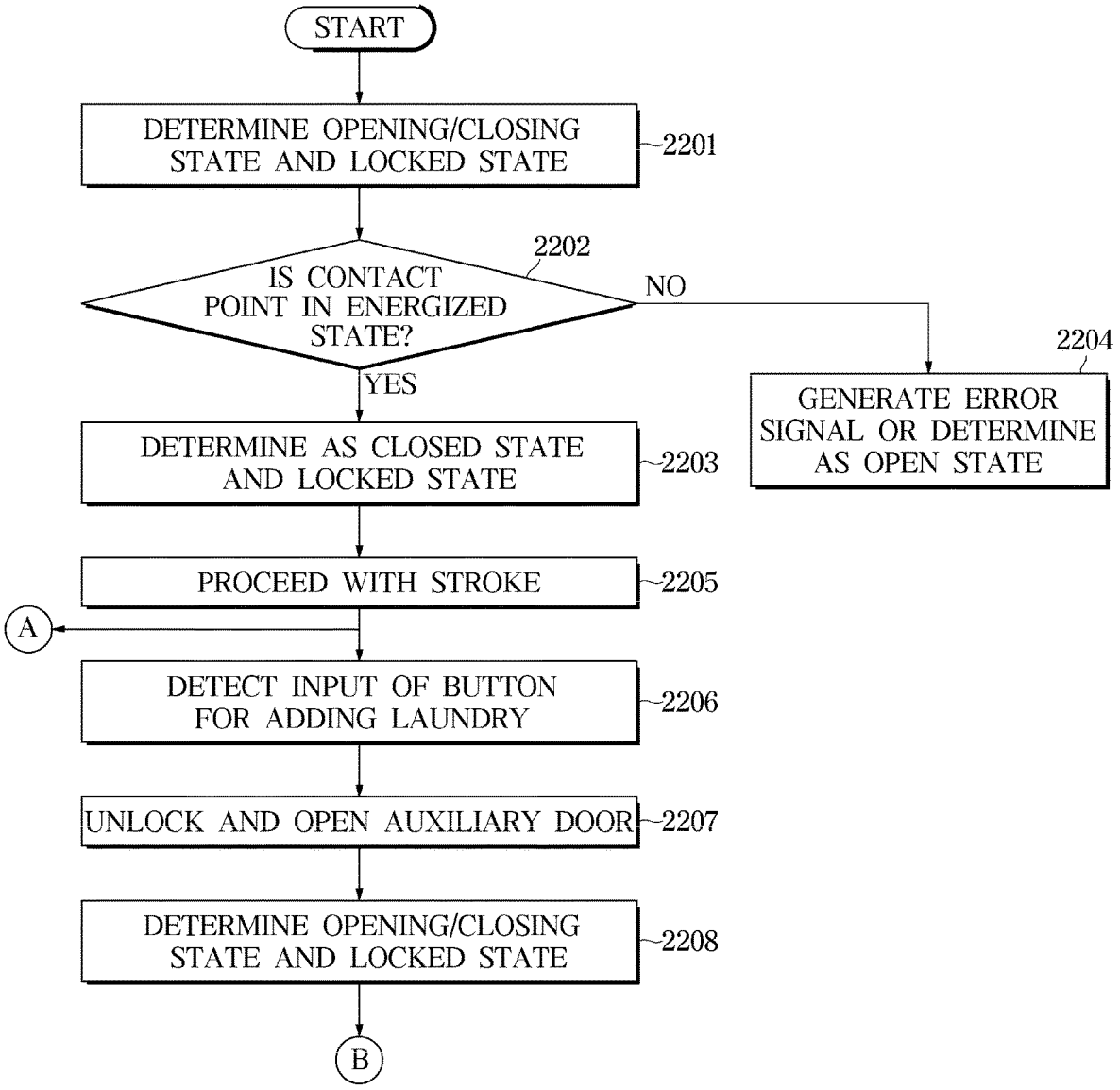
FIG. 28*a* is a flowchart showing a method of controlling the washing machine according to an embodiment of the disclosure.
Figure 28B:
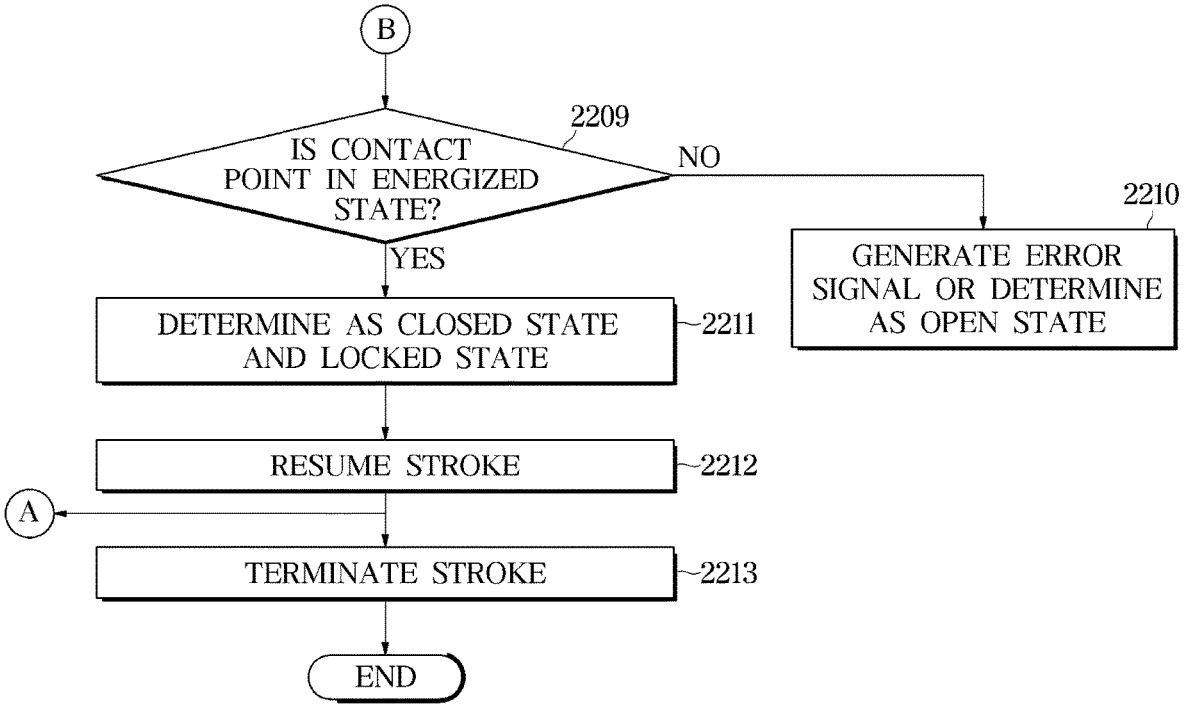
FIG. 28*b* is a flowchart showing a method of controlling the washing machine according to an embodiment of the disclosure.
Figure 29:
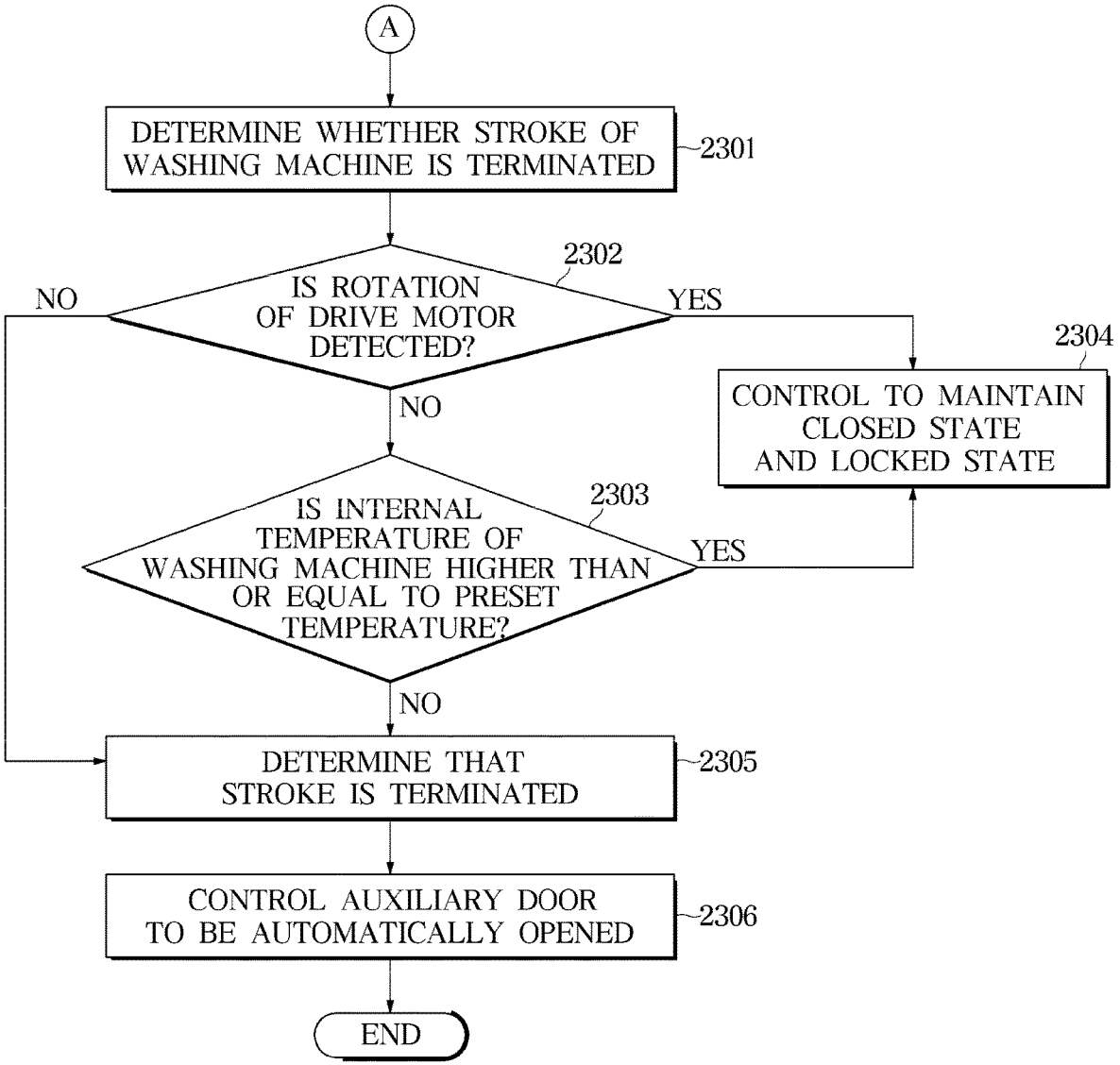
FIG. 29 is a flowchart referenced by FIG. 28*a* and FIG. 28*b*.

FIG. 28*a* and FIG. 28*b* is a flowchart showing a method of controlling the washing machine according to the fifth embodiment of the disclosure, and FIG. 29 is a flowchart referenced by FIG. 28*a* and FIG. 28*b*. However, this is only an exemplary embodiment for achieving the object of the disclosure, and some operations may be added or omitted as needed. It should be understood that the method of controlling the washing machine according to the embodiment of the disclosure may be performed directly or indirectly by the controller 320.

Here, the controller 320 is provided to control various electric components constituting the washing machine 1, and may include a processor that may be configured as an integrated circuit for providing a control signal to the various electric components, in which the processor may include an arithmetic logic operator, a register, a program counter, an instruction decoder, a control circuit, and the like.

According to the embodiment, the controller 320 may control the stroke of the washing machine 1 and the operation of the auxiliary door according to a sensing result of the door sensor 310 provided in the main body. The stroke of the washing machine 1 may include at least one of a washing stroke, a rinsing stroke, and a spin-drying stroke. In addition, the operation of the auxiliary door may include an operation of automatically opening or closing the auxiliary door.

The controller 320 may determine at least one of an opening/closing state of the auxiliary door or a locking state of the auxiliary door through the door sensor 310 (2201). In addition, as described above, the controller 320 may detect the position of the sensing protrusion 141 or the intermediate member 143 having passed through the intermediate hole 142 using the door sensor 310, or may detect the position of the sensing protrusion 141 or the intermediate member 143 at a time of passing through the intermediate hole 142 formed in the door using the door sensor 310, to thereby determine at least one of an opening/closing state of the door 100 or a locking state of the door 100.

The determination may be achieved based on the sensing result of the door sensor 310. For example, the sensing result may be a result of whether a contact has occurred between the sensing protrusion 141 or the intermediate member 143 and the door sensor 310.

On the other hand, the detector 311 of the door sensor 310 is provided with a switch that includes at least one contact point to pass or block an electrical signal. For example, the switch may be a reed switch or a micro switch, but the switch according to the disclosure is not limited thereto as long as it can pass or block an electrical signal a pulse wave. The contact point of the switch may be in an open state when the auxiliary door 120 is open, or may be in a shorted state when the auxiliary door 120 is closed, that is, in an energized state. As a result, the controller 320 may determine whether the auxiliary door 120 is opened or closed based on the state of the contact point.

The controller 320 detects whether the contact point is in the energized state (2202), and when the contact point is in an energized state, determines that the auxiliary door 120 is in a closed state and a locked state (2203). On the contrary, when the contact point is not in an energized state, the controller 320 may generate an error signal or as a result of determining an open state, control the washing machine 1 not to proceed with the stroke (2204).

When the controller 320 determines that the auxiliary door is in a closed state and a locked state, the controller 320 may control the stroke of the washing machine 1 to be proceeded (2205). As described above, according to the structure of the washing machine 1 with the disclosure, when the auxiliary door 120 is in a closed state and a locked state, the door 100 is also considered to be in a closed state and a locked state, which is considered a situation suitable for performing a series of strokes.

The controller 320, in response to detecting an input of a button for adding laundry by a user during the stroke of the washing machine (2206), controls the auxiliary door 120 to be set into an unlocked state and an open state (2207). In this case, the user may add laundry by opening the auxiliary door 120, and when the user closes the auxiliary door 120 after the addition of the laundry is completed, the controller 320 determines again the opening/closing state of the auxiliary door and the locked state of the auxiliary door (2208).

Herein, the controller 320 detects whether the contact point of the switch is in an energized state to determine whether the auxiliary door 120 is opened or closed and whether the auxiliary door 120 is locked (2209). Details thereof are described with reference to operation 2202. In addition, the controller 320 performs a control corresponding to a case when the contact point is not in an energized state (2210). The control is described with reference to operation 2204.

Then, the controller 320 controls the washing machine 1 to resume the stroke of the washing machine 1 (2212).

Thereafter, the controller 320 determines whether the stroke of the washing machine is terminated (2213). The controller 320, in order to determine whether it is safe to open the door 100 before opening the door 100, may determine whether the opening of the door 100 is allowable based on the rotation of the drive motor 7 and the internal temperature of the washing machine 1.

On the other hand, as described above, the controller 320 may control the operation of the auxiliary door 120 in addition to controlling the stroke of the washing machine 1. This will be described in detail with reference to FIG. 29.

The controller 320 determines whether the stroke of the washing machine 1 is terminated to perform an operation control of opening the auxiliary door 120 (2301). The controller 320 performs at least one of operations 2302 and 2303 described below to determine whether it is safe to open the auxiliary door 120 before opening the auxiliary door 120. As shown in the flowchart, whether or not the stroke of the washing machine 1 is terminated may be determined based on the rotation of the drive motor 7 and the temperature inside the washing machine.

In operation 2302, the controller 320 detects the rotation of the drive motor 7. In detail, the controller 320 determines whether the drive motor 7 is stopped or whether the rotational speed of the drive motor 7 is lower than a preset rotational speed. Operation 2302 is to prevent a safety accident that may occur when laundry is additionally input or removed through the auxiliary door 120.

In operation 2303, the controller 320 measures the internal temperature of the washing machine 1 through a temperature sensor (not shown), and determines whether the measured internal temperature of the washing machine 1 is lower than a preset temperature. Operation 2303 is to prevent burn due to the high temperature of air inside the washing machine 1 when laundry is additionally added or is removed through the auxiliary door 120.

On the other hand, when it is determined as a result of performing operation 2302 or 2303 that the drive motor 7 is rotating, the rotational speed of the drive motor 7 is greater than or equal to the preset rotational speed, or the temperature inside the washing machine 1 is higher than or equal to the present temperature, the controller 320 may control the auxiliary door 120 to be maintained in a closed state and a locked state (2304).

On the contrary, when it is determined as a result of performing operation 2302 or 2303 that at least one of: the drive motor 7 is rotating; the rotational speed of the drive motor 7 is greater than or equal to the preset rotational speed; or the temperature inside the washing machine 1 is higher than or equal to the present temperature is satisfied, the controller 320 determines that the stroke of the washing machine 1 is terminated (2305).

When it is determined in operation 2305 that the stroke of the washing machine 1 is terminated, the controller 320 controls the unlock device 800 to automatically open the auxiliary door 120. In this case, the auxiliary door 120 may be opened as the locking member 710 or the locking device 700 is pressed by the unlock device 800. (2306)

As is apparent from the above, the disclosure can improve the assembly of a door by a washing machine door having a simple configuration that omits an electrical device for opening and closing an auxiliary door in the washing machine door.

The disclosure can easily open and close the washing machine door through a simple control performed inside a main body.

Although few embodiments of the disclosure have been shown and described, the above embodiment is illustrative purpose only, and it would be appreciated by those skilled in the art that changes and modifications may be made in these embodiments without departing from the principles and scope of the disclosure, the scope of which is defined in the claims and their equivalents.

What is claimed is:

1. A washing machine comprising:

a main body having a first inlet, the main body including a pressing device arranged inside the main body;

a drum arranged inside the main body to accommodate laundry; and a door configured to open and close the first inlet, wherein the door includes:

a second inlet provided to allow laundry to be introduced into the drum while the first inlet is closed, an auxiliary door configured to open and close the second inlet, and a restraining device configured to lock the auxiliary door to the door while the pressing device presses onto the restraining device and unlock the auxiliary door from the door while the pressing device is released from pressing the restraining device.

2. The washing machine of claim 1, further comprising a controller arranged inside the main body and configured to transmit an electrical signal to the pressing device, wherein the pressing device is provided to be electrically connected to the controller inside the main body.

3. The washing machine of claim 2, wherein the restraining device is not electrically connected to the controller.

4. The washing machine of claim 1, wherein the auxiliary door comprises an insertion portion insertable into the restraining device by rotationally moving in a first direction, wherein the restraining device comprises:

a first restraining part allowing the insertion portion to be inserted thereinto and restraining the insertion portion; and a second restraining part configured to restrain the first restraining part while the pressing device presses onto the restraining device.

5. The washing machine of claim 4, wherein the first restraining part is configured to restrain the auxiliary door to maintain the auxiliary door in a closed state while the insertion portion is inserted into the first restraining part, and release the restraining of the auxiliary door to allow the auxiliary door to open while the auxiliary door is pressed in the first direction.

6. The washing machine of claim 5, wherein the pressing device is configured to press the second restraining part, and the second restraining part is configured to restrain the first restraining part while the pressing device is pressing the second restraining part such that the auxiliary door is locked in a state of being restrained by the first restraining part.

7. The washing machine of claim 6, wherein the second restraining part is configured to release the restraining of the first restraining part in response to the pressing device being released from the second restraining part.

8. The washing machine of claim 7, wherein the first restraining part and the second restraining part are arranged in a vertical direction, and the second restraining part is protruded in a direction toward the first restraining part by being pressed by the pressing device to restrain the first restraining part.

9. The washing machine of claim 6, wherein the first restraining part is configured to be moved in the first direction while the insertion portion is inserted into the first restraining part, and moved in a second direction opposite to the first direction in response to the auxiliary door being pressed in the first direction, and the first restraining part alternates moving in the first direction to a first position in which the insertion portion is restrained by the first restraining part and moving in the second direction to a second position in which the restraining of the insertion portion by the first restraining part is released.

10. The washing machine of claim 9, wherein the second restraining part is moved in the second direction by being pressed by the pressing device and is moved in the first direction in response to the pressing of the pressing device being released, and the second restraining part alternates moving in the second direction to a third position in which the first restraining part is restrained by the second restraining part and moving in the first direction to a fourth position in which the restraining of the first restraining part by the second restraining part is released.

11. The washing machine of claim 1, wherein the restraining device is configured to lock the auxiliary door in response to at least a portion of the auxiliary door being inserted into the restraining device, and the pressing device is configured to release the locking of the auxiliary door by pressing the restraining device.

12. The washing machine of claim 11, wherein the restraining device comprises:

a locking portion arranged on the auxiliary door and allowing the auxiliary door to be locked onto the restraining device; and a locking member arranged on the door and configured to lock the locking portion, wherein the locking member is rotated in association with pressing of the locking portion generated in an operation of closing the auxiliary door, whereby the locking member is inserted into the locking portion such that the auxiliary door is locked onto the restraining device, and the locking member is rotated in association with pressing of the pressing device, whereby the locking member is separated from the locking portion such that the auxiliary door is unlocked from the restraining device.

13. The washing machine of claim 2, wherein the main body further comprises a door sensor arranged inside the main body and electrically connected to the controller to detect a closed state of the auxiliary door, and the controller controls the pressing device to press the restraining device in response to the door sensor detecting the closed state of the auxiliary door.

14. The washing machine of claim 2, wherein the controller is configured to control a stroke of the washing machine, and controls the washing machine to perform the stroke only while the restraining device is being pressed by the pressing device.

15. The washing machine of claim 2, wherein the pressing device further comprises:

a push rod configured to be protruded in a direction of an outer side of the main body to press the restraining device, and a detecting sensor configured to detect a distance the push rod moved, and wherein the controller an operation of the washing machine from being performed in response to a value detected by the detecting sensor as being smaller than a predetermined value.

16. A washing machine comprising:

a main body having a first inlet, the main body including a locking guide arranged inside the main body;

a drum arranged inside the main body to accommodate laundry; and a door configured to open and close the first inlet, wherein the door comprises:

a second inlet through which laundry is introduced into the drum while the first inlet is closed, an auxiliary door configured to open and close the second inlet, and a restraining device configured to lock the auxiliary door to the door while the locking guide presses onto the restraining device and unlock the auxiliary door from the door while the locking guide is released from pressing the restraining device.

17. The washing machine of claim 16, wherein the restraining device comprises:

a first restraining part configured to restrain the auxiliary door to maintain the auxiliary door closed, and release the restraining of the auxiliary door to open the door in response to the auxiliary door being pressed by an external force; and a second restraining part configured to restrain the first restraining part such that the auxiliary door is locked in a state of being restrained by the first restraining part.

18. The washing machine of claim 17, wherein the locking guide is configured to press the second restraining part, and the second restraining part is configured to restrain the first restraining part while the second restraining part is being pressed by the locking guide.

19. The washing machine of claim 16, wherein the door omits an electrically connected component.

* * * * *